US009982563B2

(12) United States Patent
Fukae et al.

(10) Patent No.: US 9,982,563 B2
(45) Date of Patent: May 29, 2018

(54) SINTERED ALLOY AND MANUFACTURING METHOD THEREOF

(71) Applicant: HITACHI CHEMICAL COMPANY, LTD., Tokyo (JP)

(72) Inventors: Daisuke Fukae, Matsudo (JP); Hideaki Kawata, Matsudo (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/830,349

(22) Filed: Dec. 4, 2017

(65) Prior Publication Data

US 2018/0094539 A1 Apr. 5, 2018

Related U.S. Application Data

(62) Division of application No. 14/194,871, filed on Mar. 3, 2014.

(30) Foreign Application Priority Data

Mar. 1, 2013 (JP) ..... 2013-040686

(51) Int. Cl.
*B22F 3/16* (2006.01)
*F01D 25/16* (2006.01)
(Continued)

(52) U.S. Cl.
CPC ..... *F01D 25/16* (2013.01); *B22F 3/12* (2013.01); *B22F 5/10* (2013.01); *C22C 33/0207* (2013.01);
(Continued)

(58) Field of Classification Search
CPC ..... B22F 1/00; B22F 1/0003; B22F 1/0011; B22F 3/12; B22F 3/16; C22C 33/02;
(Continued)

(56) References Cited

U.S. PATENT DOCUMENTS 4,556,533 A 12/1985 Daku et al.
4,561,889 A 12/1985 Daku et al.
(Continued)

FOREIGN PATENT DOCUMENTS

DE 10203376 A1 10/2002
EP 1775351 A1 4/2007
(Continued)

OTHER PUBLICATIONS

Jul. 13, 2017 U.S. Office Action Issued in U.S. Appl. No. 14/194,871.
(Continued)

*Primary Examiner* — Colleen Dunn
*Assistant Examiner* — Anthony Liang
(74) *Attorney, Agent, or Firm* — Oliff PLC

(57) ABSTRACT

A sintered alloy includes, in percentage by mass, Cr: 10.37 to 39.73, Ni: 5.10 to 24.89, Si: 0.14 to 2.52, Cu: 1.0 to 10.0, P: 0.1 to 1.5, C: 0.18 to 3.20 and the balance of Fe plus unavoidable impurities; a phase A containing precipitated metallic carbide with an average particle diameter of 10 to 50 μm; and a phase B containing precipitated metallic carbide with an average particle diameter of 10 μm or less, wherein the phase A is randomly dispersed in the phase B and the average particle diameter DA of the precipitated metallic carbide in the phase A is larger than the average particle diameter DB of the precipitated metallic carbide of the phase B.

6 Claims, 2 Drawing Sheets

(51) Int. Cl.

| | |
|---|---|
| ***C22C 38/56*** | (2006.01) |
| ***C22C 33/02*** | (2006.01) |
| ***C22C 38/34*** | (2006.01) |
| ***C22C 38/02*** | (2006.01) |
| ***C22C 38/00*** | (2006.01) |
| ***B22F 5/10*** | (2006.01) |
| ***C22C 38/42*** | (2006.01) |
| ***B22F 3/12*** | (2006.01) |
| *B22F 5/00* | (2006.01) |

(52) U.S. Cl.
CPC ..... *C22C 33/0285* (2013.01); *C22C 38/002* (2013.01); *C22C 38/02* (2013.01); *C22C 38/34* (2013.01); *C22C 38/42* (2013.01); *C22C 38/56* (2013.01); *B22F 5/009* (2013.01); *B22F 2998/10* (2013.01)

(58) Field of Classification Search
CPC ..... C22C 33/0207; C22C 33/0257; C22C 33/0285; C22C 38/02; C22C 38/08; C22C 38/12; C22C 38/18; C22C 38/22; C22C 38/24; C22C 38/26; C22C 38/34; C22C 38/36; C22C 38/40; C22C 38/44; C22C 38/48; C22C 38/56
See application file for complete search history.

(56) References Cited

U.S. PATENT DOCUMENTS

| | | | |
|---|---|---|---|
| 6,852,143 | B2 | 2/2005 | Hayashi et al. |
| 2005/0095163 | A1 | 5/2005 | Yoshihiro et al. |
| 2007/0086910 | A1 | 4/2007 | Liang |
| 2009/0269235 | A1 | 10/2009 | Fukae et al. |
| 2010/0147247 | A1 | 6/2010 | Qiao et al. |

FOREIGN PATENT DOCUMENTS

| | | | |
|---|---|---|---|
| EP | 2163331 | A1 | 3/2010 |
| EP | 2511031 | A1 | 10/2012 |
| JP | 3784003 | B2 | 6/2006 |
| JP | 2009-263722 | A | 11/2009 |
| JP | 2010215951 | A | 9/2010 |

OTHER PUBLICATIONS

"Fine nickel improves part performance in high-stress areas," Metal Powder Report, May 1, 2005, pp. 16-19, vol. 60, No. 5.
Extended European Search Report issued in European Patent Application No. 14157394.9 dated Sep. 24, 2014.

SINTERED ALLOY AND MANUFACTURING METHOD THEREOF

CROSS-REFERENCE TO RELATED APPLICATIONS

This is a Divisional of application Ser. No. 14/194,871 filed Mar. 3, 2014, which is based upon and claims the benefit of priority from the prior Japanese Patent Application No. 2013-040686 filed on Mar. 1, 2013; the entire contents which are incorporated herein by reference.

BACKGROUND

1. Field of the Invention

The present invention relates to a sintered alloy which is suitable for a turbo component for turbocharger, particularly a heat resistant bearing and the like which require heat resistance, corrosion resistance and wear resistance, and a method for manufacturing the sintered alloy.

2. Background of the Invention

Generally, in a turbocharger provided in an internal combustion engine, a turbine is rotatably supported by a turbine housing connected with an exhaust manifold of the internal combustion engine. An exhaust gas flowed in the turbine housing is flowed in the turbine from the outside thereof and emitted in the axial direction thereof while the turbine is rotated. Then, air to be supplied into the internal combustion engine is compressed by the rotation of an air compressor which is provided at the same shaft in the opposite side of the turbine. In such a turbocharger as described above, when the exhaust gas is flowed in the turbine housing from the exhaust manifold, the exhaust gas is separated by the nozzle vanes and valves to control the inflow therein in order to obtain the stable boost pressure and prevent the damages of the turbocharger and the engine.

The bearings supporting the corresponding valves are subject to the exposure of high temperature exhaust gas and requires excellent wear resistance. Moreover, since the bearings are exposed to the air with the turbine housing and thus located under corrosion atmosphere causing salt damage, the bearings requires excellent corrosion resistance.

Moreover, since the turbo component for turbo charger is contacted with the exhaust gas as the high temperature corrosion gas, the turbo component requires heat resistance and corrosion resistance and wear resistance because the turbo component is slid relative to nozzle vanes and valve shafts. In this point of view, conventionally, high chrome cast steel, wear-resistant material made of JIS (Japanese Industrial Standards) SCH22 to which chrome surface treatment is conducted for the enhancement of corrosion resistance and the like are used. Moreover, as an inexpensive wear-resistant component having heat resistance, corrosion resistance and wear resistance is proposed a wear-resistant sintered component in which carbide is dispersed in the base material of a ferric steel material (Refer to Patent document No. 1).

However, since the sintered component disclosed in Patent document No. 1 is formed through liquid phase-sintering, the sintered component may be machined as the case of severe dimensional accuracy. Since the large amount of hard carbide is precipitated in the sintered component, the machinability of the sintered component is not good and thus required to be improved. Moreover, the turbo component is normally made of austenitic heat-resistant material, but the turbo component disclosed in Patent document No. 1 is made of ferritic stainless material. In this case, since the thermal expansion coefficient of the turbo component is different from those of the adjacent components, some spaces are formed between the turbo component and the adjacent components, causing the insufficient connections between the turbo component and the adjacent components and rendering component design available in the turbocharger difficult. It is therefore desired that the turbo component has a similar thermal expansion coefficient to those of the adjacent components made of austenitic heat-resistant material.

On the other hand, since a transportation machine such as a vehicle where the turbo charger is mounted is used within a wide range environmental from warm area to cold area, the turbo charger also is required to have excellent wear resistance and corrosion resistance within the wide range environmental. For example, in a cold district, sodium chloride (NaCl) or calcium chloride ($CaCl_2$) is scattered as antifreeze or liquefacient on the road surface. Since a large amount of salt water with high concentration exists on the road surface by the melting of the snow and ice, the high concentration salt water is splashed and adhered to the rear side of the transportation machine when the transportation machine runs on the road surface. A large amount of chloride ion contained in the high concentration salt water breaks the passive film formed at the surface of stainless steel and causes the corrosion against the stainless steel. Therefore, when the heat resistant bearings for turbo charger are made of the stainless steel, some corrosion problems such as salt damage are caused.

It is said that the salt damage corrosion mechanism is originated from that the passive film ($Cr_2O_3$) is reacted with $H_2O$ in addition to Na of NaCl to form water soluble $Na_2CrO_4$ to be able to melt the passive film. Then, it is considered that Cr is appropriately supplied from the interior of the stainless steel to the passive film with the melting of the passive film so that the amount of Cr in the stainless steel becomes short.

Under the circumference of salt damage corrosion, corrosion is caused even in the sintered alloy disclosed in Patent document No. 1, so that such a new sintered alloy as having wear resistance and corrosion resistance.

Patent document No. 1: Japanese Patent publication No. 3784003

BRIEF SUMMARY OF THE INVENTION

It is an object of the present invention to provide a sintered alloy which has excellent heat resistance, wear resistance and corrosion resistance against salt damage caused in a cold district. It is also an object of the present invention to provide a method for manufacturing the sintered alloy.

In order to solve out the aforementioned problem, the first gist of a sintered alloy according to the present invention is that the sintered alloy is consisted of two kinds of phases: one is a phase A containing larger dispersed carbide therein and having heat resistance and corrosion resistance, and the other is a phase B containing smaller dispersed carbide therein and having heat resistance and corrosion resistance, and that the sintered alloy has such a metallic structure as the phase A is dispersed in the phase B randomly. The phase B containing smaller dispersed carbide enhances the conformability of the carbide dispersed therein, allowing the enhancement of the wear resistance thereof and reducing the attack on the opponent component so as to prevent the abrasion of the opponent component, as compared with a sintered alloy containing larger carbide dispersed uniformly. Moreover, since the size of the carbide is small, the attack of the carbide on the edge of a cutting tool is reduced so as to contribute to the enhancement of machinability. However, if the sintered alloy includes only the phase B, plastic flow may be likely to be generated in the sintered alloy. In the present invention, therefore, the plastic flow of the phase B is prevented by randomly dispersing the phase A containing larger dispersed carbide therein into the phase B, thereby contributing to the wear resistance of the sintered alloy. Since the sintered alloy of the present invention is configured as described above, the sintered alloy can strike the balance between the enhancement of wear resistance and the enhancement of machinability.

The second gist of the sintered alloy of the present invention is that nickel is contained in the phase A and the phase B so that both of the phase A and the phase B have respective austenitic structures. In this manner, if the base material of the sintered alloy is entirely rendered austenitic structure, the heat resistance and corrosion resistance of the sintered alloy can be enhanced at high temperature while the sintered alloy can have a similar thermal expansion coefficient to those of the adjacent austenitic heat-resistance materials.

The third gist of the sintered alloy of the present invention is that copper is contained therein to form a film made of copper suboxide ($Cu_2O$) so as not to be destroyed by salt, thereby suppressing the anode reaction for the corresponding chloride ion and salt damage corrosion.

Concretely, the sintered alloy of the present invention is characterized by essentially consisting of, in percentage by mass, Cr: 10.37 to 39.73, Ni: 5.10 to 24.89, Si: 0.14 to 2.52, Cu: 1.0 to 10.0, P: 0.1 to 1.5, C: 0.18 to 3.20 and the balance of Fe plus unavoidable impurities and characterized in that the phase A containing precipitated metallic carbide with an average particle diameter of 10 to 50 μm is randomly dispersed in the phase B containing precipitated metallic carbide with an average particle diameter of 10 μm or less and the average particle diameter DA of the precipitated metallic carbide of the phase A is larger than the average particle diameter DB of the precipitated metallic carbide of the phase B (i.e., DA>DB).

In an aspect of the sintered alloy of the present invention, the maximum diameter of the phase A is 500 m or less and the occupied area of the phase A is within a range of 20 to 80% relative to the total of the phase A and the phase B (i.e., all of the base material of the sintered alloy except pore).

The first gist of the manufacturing method of the sintered alloy according to the present invention is that iron alloy powder A containing precipitated carbide by the preliminary addition of carbon and iron alloy powder B not containing precipitated carbide not by the preliminary addition of carbon are used in order to obtain the sintered alloy having the phase A containing dispersed larger carbide and the phase B containing dispersed smaller carbide and having the metallic structure in which the phase A is randomly dispersed in the phase B.

The second gist of the manufacturing method of the present invention is that nickel is contained in the iron alloy powder A and the iron alloy powder B and nickel powder are added to the iron alloy powder A and the iron alloy powder B so as to render the phase A and phase B austenitic structure.

The third gist of the manufacturing method of the present invention is that copper or copper powder is added to the phase A and phase B in order to enhance the corrosion resistance thereof.

Concretely, the manufacturing method of the sintered alloy according to the present invention is characterized by including the steps of preparing iron alloy powder A consisting of, in percentage by mass, Cr: 25 to 45, Ni: 5 to 15, Si: 1.0 to 3.0, C: 0.5 to 4.0 and the balance of Fe plus unavoidable impurities, preparing iron alloy powder B consisting of, in percentage by mass, Cr: 12 to 25, Ni: 5 to 15 and the balance of Fe plus unavoidable impurities, preparing iron-phosphorus powder consisting of, in percentage by mass, P:10 to 30 and the balance of Fe plus unavoidable impurities or P:5 to 25 and the balance of Cu plus unavoidable impurities, nickel powder, copper powder or copper alloy powder and graphite powder, blending raw material powder, consisting of, in percentage by mass, Cr: 10.37 to 39.73, Ni: 5.10 to 24.89, Si: 0.14 to 2.52, Cu: 1.0 to 10.0, P: 0.1 to 1.5, C: 0.18 to 3.20 and the balance of Fe plus unavoidable impurities by mixing the iron alloy powder A with the iron alloy powder B so that a ratio of the iron alloy powder A to the total of the iron alloy powder A and the iron alloy powder B is within a range of 20 to 80 mass %, and adding the iron-phosphorus powder, the nickel powder, the copper powder or copper alloy powder and the graphite powder; pressing the raw material powder to obtain a compact; and sintering the compact.

In a preferred embodiment of the manufacturing method of the present invention, the maximum particle diameter of the iron alloy powder A and the iron alloy powder B is within a range of 300 μm or less (which corresponds to the diameter of powder passing a sieve with 50 mesh) respectively, and the maximum particle diameter of the nickel powder is within a range of 43 μm or less (which corresponds to the diameter of powder passing a sieve with 325 mesh). In another preferred embodiment, at least one of the iron alloy powder A and the iron alloy powder B contains 1 to 5 mass % of at least one selected from the group consisting of Mo, V, W, Nb, and Ti relative to the aforementioned iron alloy powder A and iron alloy powder B, and the preferred sintering temperature is within a range of 1000 to 1200° C.

The sintered alloy of the present invention is suitable for a turbo component for turbocharger, and has the phase A containing precipitated metallic carbide with an average particle diameter of 10 to 50 μm and the phase B containing precipitated metallic carbide with an average particle diameter of 10 μm or less so as to exhibit the metallic structure such that the phase A is randomly dispersed in the phase B, thereby having excellent heat resistance, corrosion resistance and wear resistance at high temperature and machinability. Moreover, since the sintered alloy of the present invention has the austenitic base material, the sintered alloy has a similar thermal expansion coefficient to that of austenitic heat-resistant material, thereby simplifying component design. Furthermore, since the sintered alloy contains copper which is against chloride ion, the sintered alloy has corrosion resistance against salt damage.

Figure 1:
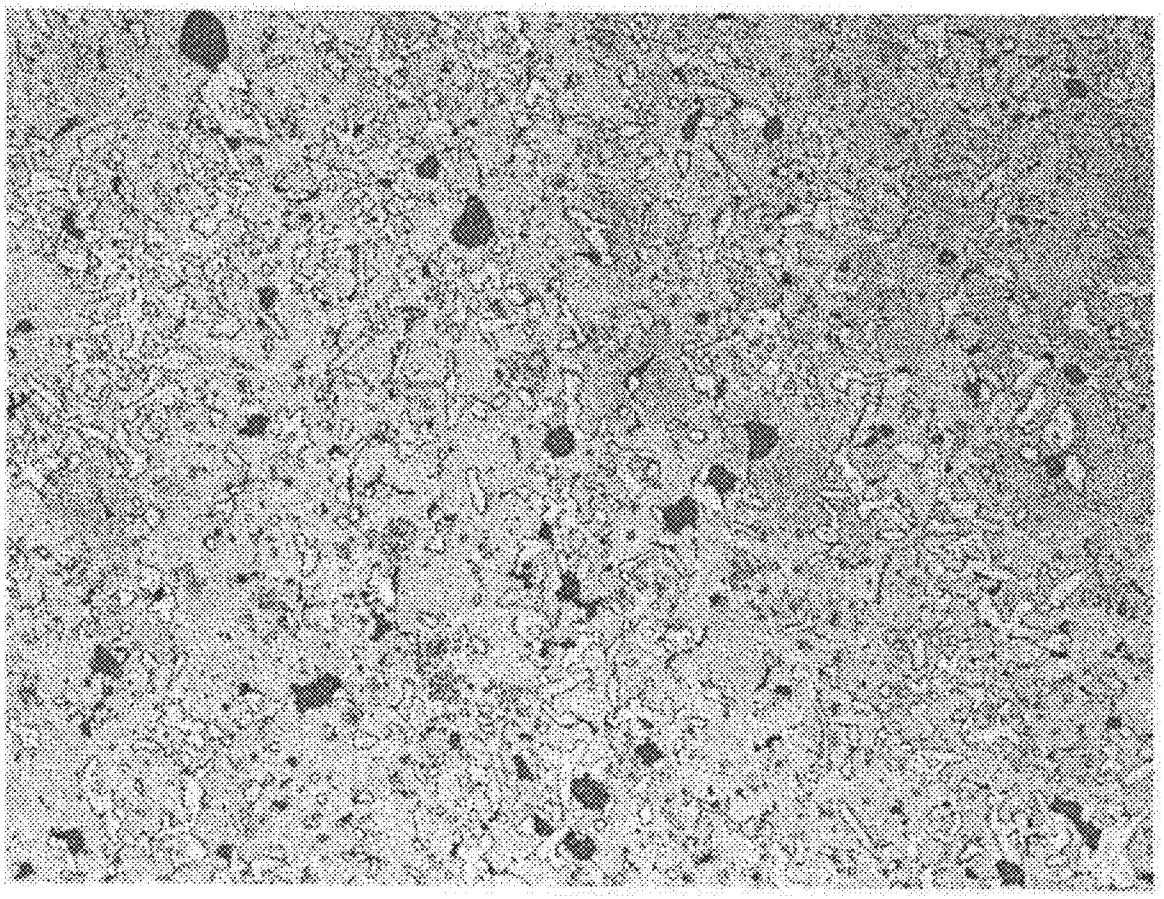
FIG. 1 is an example of metallic structure photograph of a sintered alloy according to the present invention.

MODE FOR CARRYING OUT THE INVENTION (Metallic Structure of Sintered Alloy)

The size of carbide affects the wear resistance of a sintered alloy containing the carbide. The wear resistance of the sintered alloy can be enhanced if the sintered alloy contains the carbide as much as possible. However, if the sintered alloy contains too much carbide, the attack on opponent components of the sintered alloy is increased while the wear resistance of the sintered alloy itself can be enhanced, which results in a large amount of wear for the total of the sintered alloy and the opponent components. In the case that only larger carbide is dispersed in the base material of the sintered alloy, if the distribution degree of the larger carbide is increased to some degrees so as to enhance the wear resistance of the sintered alloy, a larger amount of carbon is required so that the distribution degree of hard carbide is increased, resulting in the deterioration of machinability of the sintered alloy.

In the sintered alloy of the present invention, the sintered alloy is consisting of two phases: one is a phase A containing larger dispersed carbide and the other is a phase B containing smaller dispersed carbide. Therefore, if the distribution degree of carbide is increased, the wear resistance of the sintered alloy can be enhanced because the amount of carbon can be entirely reduced in the sintered alloy, which allows the attack on the opponent components of the sintered body to be reduced and enhances the machinability of the sintered body.

The larger carbide phase prevents the adhesive wear of the base material of the sintered alloy and the plastic flow of the sintered alloy. Therefore, the carbide with a diameter of not less than 10 μm cannot contribute to the prevention of the plastic flow of the sintered alloy. On the other hand, if the carbide has a diameter of more than 50 μm, the carbide is aggregated so as to locally attack the opponent components. If the carbide grows too large, the space between the adjacent carbide is enlarged so that the areas of the base material not containing the carbide, which are likely to be the origin of the adhesive wear of the sintered alloy, are also enlarged. In this point of view, the size of the carbide contained in the phase A is set within a range of 10 to 50 μm as an average particle diameter.

The areas where no carbide is precipitated except the areas containing the phase A having the larger dispersed carbide therein promote the adhesive wear on the opponent component. Therefore, carbide is needed to be dispersed in the areas except the areas containing the phase A having the larger carbide so as to prevent the adhesive wear. In this point of view, the areas except the areas containing the phase A having the larger carbide are rendered the phase B containing smaller dispersed carbide. In this manner, by setting the size of the carbide contained in the phase B smaller than the size of the carbide contained in the phase A, the total amount of carbon can be reduced so that the total amount of carbide can be also reduced while the carbide distribution is kept at high degree.

The size of the smaller carbide dispersed in the phase B is set small enough to prevent the adhesive wear of the sintered alloy, and concretely within a range of 10 μm or less and preferably within a range of 2 μm or more. If the size of the carbide dispersed in the phase B is set more than 10 μm, the carbide grows too large to deteriorate the distribution degree of the carbide and thus deteriorate the wear resistance of the sintered alloy. Moreover, if the size of the carbide dispersed in the phase B is set less than 2 μm, the adhesive wear of the sintered alloy may not be sufficiently suppressed.

Furthermore, it is required that the average particle diameter DA of the metallic carbide precipitated in the phase A is larger than the average particle diameter DB of the metallic carbide precipitated in the phase B (i.e., DA>DB). Namely, if the average particle diameter DA of the metallic carbide precipitated in the phase A is set equal to the average particle diameter DB of the metallic carbide precipitated in the phase B, the phase B containing the smaller dispersed carbide cannot be formed independently from the phase A containing the larger dispersed carbide so that any one of the enhancement of wear resistance, the reduction of the attack on the opponent components and the enhancement of machinability of the sintered alloy cannot be realized. The average particle diameter is calculated as follows. The cross section of the sintered alloy is mirror-polished and corroded with royal water (sulfuric acid:nitric acid=1:3) so that the metallic structure of the cross section is observed by a microscope of 200 magnifications and analyzed in image by an image processor (WinROOF, made by MITANI CORPORATION) so as to measure the particle diameter of carbide in each of the phases A and B and calculate the average particle diameters thereof as the respective circular shaped particles.

By randomly dispersing the phase A containing the larger dispersed carbide in the phase B containing the smaller dispersed carbide, the wear resistance of the sintered alloy can be maintained while the distribution degree of carbide can be maintained at high degree and the total amount of carbon can be reduced, thereby allowing the attack on the opponent component to be decreased and the machinability to be enhanced.

The ratio of the phase A containing the larger dispersed carbide to the phase B containing the smaller dispersed carbide is set within a range of 20 to 80% with respect to the cross sectional area of the sintered alloy, that is, the base material of the sintered alloy except pore. If the ratio is set less than 20%, the amount of the phase A maintaining the wear resistance is in short supply, resulting in the deterioration of the wear resistance. On the other hand, if the ratio is set more than 80%, the rate of phase contributing to the attack on the opponent components is excessively increased, resulting in the promotion of the attack on the opponent components and in the deterioration of the machinability due to the increase of the larger carbide. The ratio of the phase A to the phase B is preferably set within a range of 30 to 70% and more preferably within a range of 40 to 60%.

The phase A containing the larger dispersed carbide is a phase where larger carbide with a size of 5 to 50 μm is concentratedly dispersed, and the dimension of the phase A is defined by the area linking the peripheries of the larger carbide. If the dimension of the phase A containing the larger dispersed carbide is set more than 500 μm, the larger carbide is likely to be locally dispersed in the phase A, resulting in the local deterioration of the wear resistance of the sintered alloy. Moreover, if cutting process is required, the lifetime of cutting tool is shortened because the hardness in the sintered alloy is locally and remarkably changed. In contrast, if the dimension of the phase A is set less than 10 μm, the size of the carbide precipitated and dispersed in the phase A is set less than 5 μm.

(Method for Manufacturing Sintered Alloy and Reason Defining Compositions of Raw Material Powder)

In order to form the metallic structure where the phase A containing the larger dispersed carbide is randomly dispersed in the phase B, an iron alloy powder A to form the phase A and an iron alloy powder B to form the phase B are mixed with one another, pressed and sintered.

The heat resistance and corrosion resistance are required for both of the phase A containing the larger dispersed carbide and the phase B containing the smaller dispersed carbide. Therefore, chromium serving as enhancing the heat resistance and the corrosion resistance of the iron base material through solid solution is contained in the phase A and the phase B. Moreover, chromium is bonded with carbon to form chromium carbide or a composite material made of chromium and iron (hereinafter, both of the chromium carbide and the composite material are abbreviated as "chromium carbide"), thereby enhancing the wear resistance of the sintered alloy. In order that such a chromium effect as described above affects the base material of the sintered alloy uniformly, the chromium is solid-solved in the iron alloy powder A and the iron alloy powder B, respectively.

The iron alloy powder A is prepared as the powder preliminarily containing the chromium carbide by adding a larger amount of chromium than that of the iron alloy powder B therein because the iron alloy powder A inherently contains carbon. In this manner, if the iron alloy powder A containing the chromium carbide therein is used, carbide grows by using the chromium carbide as nucleus, which is preliminarily formed in the iron alloy powder A, during sintering, thereby forming the phase A containing the larger dispersed carbide. In order to obtain such an effect as described above, the iron alloy powder A contains, in percentage by mass, Cr: 25 to 45 and C: 0.5 to 4.0.

Since the chromium carbide is preliminarily precipitated and dispersed in the iron alloy powder A, if the content of the chromium is less than 25 mass %, the chromium is in a short supply in the base material of the sintered alloy, resulting in the deterioration of the heat resistance and the corrosion resistance of the phase A made of the iron alloy powder A. On the other hand, if the content of the chromium of the iron alloy powder A is more than 45 mass %, the compressibility of the iron alloy powder A is remarkably deteriorated. Therefore, the upper limited value of the content of the chromium in the iron alloy powder A is set to 45 mass %.

If the content of the carbon in the iron alloy powder A is less than 0.5 mass %, the chromium carbide is in a short supply so that the carbide serving as the nucleus during the sintering are also in a short supply, thereby having a difficulty in setting the size of the carbide to be dispersed in the phase A within the aforementioned range. On the other hand, if the carbon of more than 4.0 mass % is contained in the iron alloy powder A, the amount of the carbide to be precipitated in the iron alloy powder A becomes too much, resulting in the increase of hardness in the iron alloy powder A and in the deterioration of the compressibility of the iron alloy powder A.

On the other hand, the content of chromium in the iron alloy powder B is set within a range of 12 to 25 mass % and the content of carbon in the iron alloy powder is set to zero. If the content of chromium in the iron alloy powder B is less than 12 mass %, chromium carbide is formed during sintering to decrease the content of chromium in the base material, resulting in the deterioration of the heat resistance and corrosion resistance of the base material of the phase B to be formed after the sintering. Moreover, the content of chromium in the iron alloy powder B is required to be reduced in order that the chromium carbide, contributing to the wear resistance, is finely dispersed, so that the upper limited value of the chromium content is set to 25 mass %.

Since the iron alloy powder B contain chromium in an amount smaller than that of the iron alloy powder A and does not contain carbon, the chromium in the iron alloy powder B is bonded with the carbon in the graphite powder as will be described hereinafter to form the chromium carbide during sintering. However, since the iron alloy powder B does not preliminarily contain the carbon, the growth rate of the chromium carbide in the iron alloy powder B are very slow so as to form the phase B containing the smaller dispersed carbide. Therefore, the iron alloy powder B contains, in percentage by mass, Cr: 12 to 25 and no carbon. Here, the term "no carbon" means that carbon is not positively added in the iron alloy powder B and allows unavoidable impurity carbon.

The carbon for precipitating and dispersing the carbide in the phase A made of the iron alloy powder A and the phase B made of the iron alloy powder B is added in the form of the graphite powder to the mixture of the iron alloy powder A and the iron alloy powder B. Therefore, the content of graphite powder corresponding to the difference between the content of carbon in the total component and the total content of carbon in the iron alloy powders A and B is added.

Here, if the content of carbon in the total component is less than 0.18 mass %, the carbide is unlikely to be precipitated, resulting in the deterioration of wear resistance. On the other hand, if the content of carbon in the total component is more than 3.2 mass %, the carbide is likely to be precipitated too much, resulting in the embrittlement of the corresponding sintered alloy, the increase of the attack on the opponent component and the deterioration of machinability of the corresponding sintered alloy. If the amount of precipitation of carbide becomes too much, the content of chromium contained in the base material of the sintered alloy is decreased, resulting in the deterioration of wear resistance and corrosion resistance of the sintered alloy. In this point of view, the content of the graphite powder is controlled and added such that the total content of carbon in view of the iron alloy powders is set within a range of 0.18 to 3.2 mass %.

The graphite powder generates Fe—P—C liquid phase with iron-phosphorus alloy powder as will be described hereinafter during sintering so as to decrease the liquefying temperature and thus promote the densification of the sintered alloy, in addition to the formation of carbide as described above.

The base material of the sintered alloy requires the heat resistance and corrosion resistance while the base material thereof has a similar thermal expansion coefficient to those of the adjacent austenitic heat-resistant materials. In the sintered alloy of the present invention, therefore, nickel is solid-solved and thus contained in the base material in order to enhance the heat resistance and the corrosion resistance of the base material of the sintered alloy and render the metallic structure of the base material of the sintered alloy the corresponding austenitic structure. The sintered alloy of the present invention has a metallic structure such that the phase A containing the larger dispersed carbide is randomly dispersed in the phase B containing the smaller dispersed carbide, and in order to render the phase A and the phase B the corresponding austenitic structures, nickel is contained in the iron alloy powder A forming the phase A and the iron alloy powder B forming the phase B while the nickel powder is contained in the iron alloy powder A and the iron alloy powder B.

If the nickel is contained in the iron alloy powder A and B, the base material of the iron alloy powder has a corresponding austenitic structure, thereby reducing the hardness of the iron alloy powder A and B and enhancing the compressibility of the iron alloy powders A and B. If the content of the nickel in the iron alloy powders A and B is less than 5 mass %, the austenitizing of the iron alloy powders A and B becomes insufficient. On the other hand, if the content of the nickel in the iron alloy powders A and B is more than 15 mass %, the compressibility of the iron alloy powders A and B cannot be enhanced. Moreover, the nickel is expensive as compared with iron and chromium and the price of the nickel bare metal soar recently. In this point of view, the content of the nickel in the iron alloy powder A and the iron alloy powder B is set within a range of 5 to 15 mass %.

If the nickel powder is added to the iron alloy powder A and the iron alloy powder B in addition to the solid-solved nickel in the iron alloy powder A and the iron alloy powder B, the densification of the sintered alloy can be promoted. The promotion effect of the densification may become poor if the additive amount of the nickel powder is less than 1 mass %. On the other hand, if the additive amount of the nickel powder is more than 12 mass %, the amount of the nickel powder becomes excess so that the nickel element of the nickel powder cannot be perfectly diffused into the iron base material of the sintered alloy and thus may remain as they are. Since no carbide is precipitated in the nickel phase formed by the remaining nickel element in the iron base material of the sintered alloy, the sintered alloy becomes likely to be adhesive to opponent components so that the abrasion is promoted from the adhesive portions of the sintered alloy and the opponent components, thereby deteriorating the wear resistance of the sintered alloy. In this point of view, the additive amount of the nickel powder to the iron alloy powder A and the iron alloy powder B is set within a range of 1 to 12 mass %.

It is preferred that the nickel phase is unlikely to remain in the iron base material after sintering as the particle diameter of the nickel powder becomes small. Moreover, the specific surface area of the nickel powder is increased so that the nickel powder is promoted in diffusion during sintering and the densification of the sintered alloy is enhanced as the particle diameter of the nickel powder becomes small. In this point of view, the maximum particle diameter of the nickel powder is preferably set to 74 μm or less (corresponding the diameter of powder which can pass a sieve with 200 mesh) and 43 μm or less (corresponding the diameter of powder which can pass a sieve with 325 mesh). The lower limited value of the particle diameter of the nickel powder is not limited, but preferably set within a range of 1 to 5 μm because nano-powder of nickel is expensive.

In the manufacture of iron alloy powder containing chromium or the like which is easily subject to oxidization, silicon is added as an deoxidizing agent into the molten melt of the iron alloy powder. However, when the silicon is solid-solved in the iron base material of the sintered alloy, the iron base material is hardened which is unfavorable effect/function. Here, since the iron alloy powder A contains the preliminarily precipitated carbide, the hardness in the iron alloy powder A is inherently large. In contrast, since the iron alloy powder B is a soft powdery material, the iron alloy powder B is mixed with the iron alloy powder A so as to ensure the compactibility of the raw material powder composed of the iron alloy powder A and the iron alloy powder B. In the manufacturing method of the sintered alloy of the present invention, therefore, a large amount of silicon, which is easily subject to oxidization, is contained in the inherently hard iron alloy powder so as to apply the effect/function of the silicon to the sintered alloy.

In this point of view, the silicon is contained in the iron alloy powder A within a range of 1.0 to 3.0 mass %. If the content of the silicon to be contained in the iron alloy powder A is set to less than 1.0 mass %, the effect/function of the silicon cannot be exhibited sufficiently. On the other hand, if the content of the silicon to be contained in the iron alloy powder A is set to more than 3.0 mass %, the iron alloy powder A becomes too hard so as to remarkably deteriorate the compressibility of the iron alloy powder A.

The silicon is not contained in the iron alloy powder B in view of the compressibility of the iron alloy powder B. However, since the iron alloy powder B contains the chromium easily subject to oxidization, the silicon of 1.0 mass % or less may be allowed as unavoidable impurity in the iron alloy powder B because the silicon can be used as a deoxidizing agent in the manufacture of the iron alloy powder.

Copper is added to the molten melt in order to enhance the strength of the sintered alloy, stabilize the passive film formed at the sintered alloy and enhance the corrosion resistance against salt such as sodium chloride (NaCl). Namely, the copper, which is solid-solved in the molten melt during sintering, is precipitated during cooling process, but is once melted under corrosion circumference so as to cover the surface of the passive film and thus suppress the anode reaction. In this point of view, the corrosion resistance against the salt such as sodium chloride can be enhanced. Here, since the solid solubility limit of the copper becomes large in the austenitic base material, the aforementioned function/effect cannot be exhibited if the content of the copper is set less than 1 mass %. On the other hand, if the content of the copper is set more than 10 mass %, excess separated Cu phase is precipitated and liquated out so as to increase the surface area of the sintered alloy, thereby allowing pitting corrosion and crevice corrosion of the sintered alloy and deteriorating the corrosion resistance of the sintered alloy.

The copper may be contained in the form of alloy in either of the iron alloy powder A and the iron alloy powder B or both of the iron alloy powder A and the iron alloy powder B. Preferably, the copper may be contained in the form of powder in the raw material powder such as the iron alloy powder A. Here, the copper forms liquid phase during sintering so as to enhance the strength of the sintered alloy. In the high chromic alloy powder such as the iron alloy powder A and the iron alloy powder B, since the passive film is formed in the state of powder, the copper liquid phase during the sintering functions as sintering agent.

The copper may be contained in the form of alloy. For example, if the copper is contained in the form of copper-nickel alloy powder in substitution of the nickel powder, the diffusion of the nickel can be promoted.

In order to generate liquid phase in the iron alloy powders A and B during sintering and thus to promote the densification of the sintered alloy, phosphorus is added in the form of iron-phosphorus powder. The phosphorus generates Fe—P—C liquid phase with the carbon during sintering to promote the densification of the sintered alloy. Therefore, the sintered alloy with a density ratio of 90% or more can be obtained. If the content of the phosphorus in the iron-phosphorus alloy powder is set less than 10 mass %, the liquid phase is not generated sufficiently so as not to contribute to the densification of the sintered alloy. On the other hand, if the content of the phosphorus in the iron-phosphorus alloy powder is set more than 30 mass %, the hardness in the iron-phosphorus powder is increased so as to remarkably deteriorate the compressibility in the iron alloy powder A and the iron alloy powder B.

If the additive amount of the iron-phosphorus alloy powder to the mixture of the iron alloy powder A and iron alloy powder B is less than 1.0 mass %, the density ratio of the sintered alloy becomes lower than 90% due to poor liquid phase. On the other hand, if the additive amount of the iron-phosphorus alloy powder to the mixture of the iron alloy powder A and iron alloy powder B is more than 5.0 mass %, excess liquid phase is generated so as to cause the losing shape of the sintered alloy during sintering. Therefore, the iron-phosphorus alloy powder containing the phosphorus within a range of 10 to 30 mass % is used while the additive amount of the iron-phosphorus alloy powder to the mixture of the iron alloy powder A and the iron alloy powder B is set within a range of 1.0 to 5.0 mass %. Although the iron-phosphorus alloy powder generates the aforementioned Fe—P—C liquid phase, the thus generated Fe—P—C liquid phase is diffused and absorbed in the iron base material of the mixture of the iron alloy powder A and the iron alloy powder B.

In the present invention, copper-phosphorous alloy powder may be employed in substation for the iron-phosphorous alloy powder. The copper-phosphorous alloy powder has lower melting point and thus can generate the corresponding liquid phase. In the case of the use of the copper-phosphorous alloy powder, it is desired, originated from the aforementioned reason, that the additive amount of the copper-phosphorous alloy powder to the mixture of the iron alloy powder A and the iron alloy powder B is set within a range of 1.0 to 5.0 mass % and the content of phosphorous of the copper-phosphorous alloy powder is set within a range of 5 to 25 mass %.

In this manner, the raw material powder is composed of the iron alloy powder A, the iron alloy powder B, the graphite powder, the nickel powder, the copper powder and the iron-phosphorus alloy powder. As described above, the iron alloy powder A includes, in percentage by mass, Cr: 25 to 45, Ni: 5 to 15, Si: 1.0 to 3.0, C: 0.5 to 4.0 and the balance of Fe plus unavoidable impurities. The iron alloy powder B includes, in percentage by mass, Cr: 12 to 25, Ni: 5 to 15 and the balance of Fe plus unavoidable impurities. Moreover, the iron-phosphorus powder includes, in percentage by mass, P: 10 to 30 and the balance of Fe plus unavoidable impurities. In the case of the use of the copper-phosphorus alloy powder, the alloy powder includes, in percentage by mass, P: 5 to 25 and the balance of Cu plus unavoidable impurities.

Among the raw material powder, the iron alloy powder A forms the phase A containing the larger dispersed carbide, and the iron alloy powder B forms the phase B containing the smaller dispersed carbide. Moreover, the graphite powder and the iron-phosphorus alloy powder generates the Fe—P—C liquid phase so as to contribute to the densification of the sintered alloy, and then diffused and absorbed in the iron base material of the sintered alloy which is made of the phase A and the phase B. By setting the ratio of the iron alloy powder A to the total of the iron alloy powder A and the iron alloy powder B within a range of 20 to 80 mass %, the ratio of the phase A to the total of the phase A and the phase B can be set within a range of 20 to 80% relative to the cross sectional area of the sintered alloy, that is, the base material of the sintered alloy except pore.

In this manner, the iron alloy powder A and the iron alloy powder B are added so that the ratio of the iron alloy powder A to the total of the iron alloy powder A and the iron alloy powder B is set within a range of 20 to 80 mass % while the iron-phosphorus alloy powder of 1.0 to 5.0 mass %, the nickel powder of 1 to 12 mass %, the copper powder of 1 to 10 mass % and the graphite powder of 0.5 to 2.5 mass % are added, thereby forming the intended raw material powder.

As is conducted from the past, the raw material powder is filled into the cavity formed by a die assembly with a die hole forming the outer shape of a component, a lower punch slidably fitted in the die hole of the die assembly and forming the lower end shape of the component, and a core rod forming the inner shape of the component or the lightening shape of the component as the case may be, and compressed by an upper punch forming the upper end shape and the lower punch. The thus obtained compact is pulled out of the die hole of the die assembly. The manufacturing method is called as "pressing process".

The compact is heated and sintered in a sintering furnace. The heating temperature, that is, the sintering temperature significantly affects the sintering process and the growing processes of carbide. If the sintering temperature is lower than 1000° C., the Fe—P—C liquid phase cannot be generated sufficiently so as not to densify the sintered alloy sufficiently and thus decrease the density of the sintered alloy, resulting in the deterioration of the wear resistance and the corrosion resistance of the sintered alloy while the size of the carbide can be maintained within a predetermined range. On the other hand, if the sintering temperature is higher than 1200° C., element diffusion is progressed so that the differences in content of some elements (particularly, chromium and carbon) between the phase A made of the iron alloy powder A and the phase B made of the iron alloy powder B become smaller and the carbide to be precipitated and dispersed in the phase B grows beyond 10 μm as an average particle diameter, resulting in the deterioration of the wear resistance of the sintered alloy while the density of the sintered alloy is increased sufficiently. Therefore, the sintering temperature is set within a range of 1000 to 1200° C.

By compressing and sintering the raw material powder as described above, the sintered alloy having the aforementioned metallic structure can be obtained. The sintered alloy includes, in percentage by mass, Cr: 10.37 to 39.73, Ni: 5.10 to 24.89, Si: 0.14 to 2.52, Cu: 1.0 to 10.0, P: 0.1 to 1.5, C: 0.18 to 3.20 and the balance of Fe plus unavoidable impurities, originated from the mixing ratio of the aforementioned material powders.

Since the phase A of the sintered alloy is made of the iron alloy powder A as described above, the dimensions of the phase A can be controlled by adjusting the particle diameters of the iron alloy powder A. In order that the maximum dimension of the phase A is set to 500 μm or less, the maximum particle size of the iron alloy powder A is set to 300 μm or less (corresponding to the size of powder passing a sieve with 50 mesh). In order that the dimension of the phase A is set to 100 μm or more, it is required that the iron alloy powder A containing 5 mass % or more of the powder having the maximum particle diameter of 500 μm or less (corresponding the size passing a sieve with 32 mesh) and 100 μm or more (corresponding the size not passing a sieve with 149 mesh) is used.

The preferred particle distribution of the iron alloy powder A is to contain 5 mass % or more of the powder having the maximum particle diameter within a range of 100 to 300 μm and to contain 50 mass % or less of the powder having the particle diameter within a range of 45 μm or less.

The particle diameter of the iron alloy powder B forming the phase B containing the smaller dispersed carbide is not restricted, but the iron alloy powder B preferably contain 90% or more of the powder having a particle distribution of 100 mesh or less.

Preferably, the sintered alloy further includes at least one selected from the group consisting of Mo, V, W, Nb and Ti. Since Mo, V, W, Nb and Ti have respective higher carbide-forming performances than Cr as carbide-forming elements, these elements can preferentially form carbide as compared with Cr. Therefore, if the sintered alloy includes these elements, the decrease in content of Cr of the base material can be prevented so as to contribute to the enhancement of the wear resistance and the corrosion resistance of the base material. Moreover, one or more of these elements are bonded with carbon to form metallic carbide, thereby enhancing the wear resistance of the base material, that is, the sintered alloy. However, if one or more of these elements are added to the raw material powder in the form of pure metallic powder, the thus formed alloys are small in diffusion velocity so that the one or more of these elements are unlikely to be diffused in the base material uniformly. Therefore, the one or more of these elements are preferably added in the form of iron alloy powder. In this point of view, when in the manufacturing method of the present invention the one or more of these elements are added as an additional element(s), the one or more of these elements are solid-solved in the iron alloy powder A and the iron alloy powder B.

If the amount of the one or more of these elements to be solid-solved in the iron alloy powder is beyond 5.0 mass %, the deterioration of the compressibility in the iron alloy powder A and the iron alloy powder B is concerned because the excess addition of the one or more of those elements hardens the iron alloy powder A and the iron alloy powder B. Therefore, 5 mass % or more of at least one selected from the group consisting of Mo, V, W, Nb and Ti is added in either or both of the iron alloy powder A and 26 the iron alloy powder B.

EXAMPLES

Example 1

The iron alloy powder A including, in percentage by mass, Cr: 34, Ni: 10, Si: 2, C: 2 and the balance of Fe plus unavoidable impurities, the iron alloy powder B including, in percentage by mass, Cr: 18, Ni: 8 and the balance of Fe plus unavoidable impurities, the iron-phosphorus powder including, in percentage by mass, P: 20 and the balance of Fe plus unavoidable impurities, the nickel powder, the copper powder and the graphite powder were prepared and mixed with one another at the ratios shown in Table 1 to blend the raw material powder. The raw material powders were compressed respectively in the shape of pillar with an outer diameter of 10 mm and a height of 10 mm, in the shape of square pillar with a length of 26 mm, a width of 11 mm and a height of 8 mm, and in the shape of thin plate with an outer diameter of 24 mm and a height of 8 mm, and then sintered at a temperature of 1100° C. under vacuum atmosphere to form sintered samples indicated by numbers of 01 to 11. The composition in each of the sintered samples was listed in Table 1 with the aforementioned ratios of the material powder to be prepared.

Figure 2:
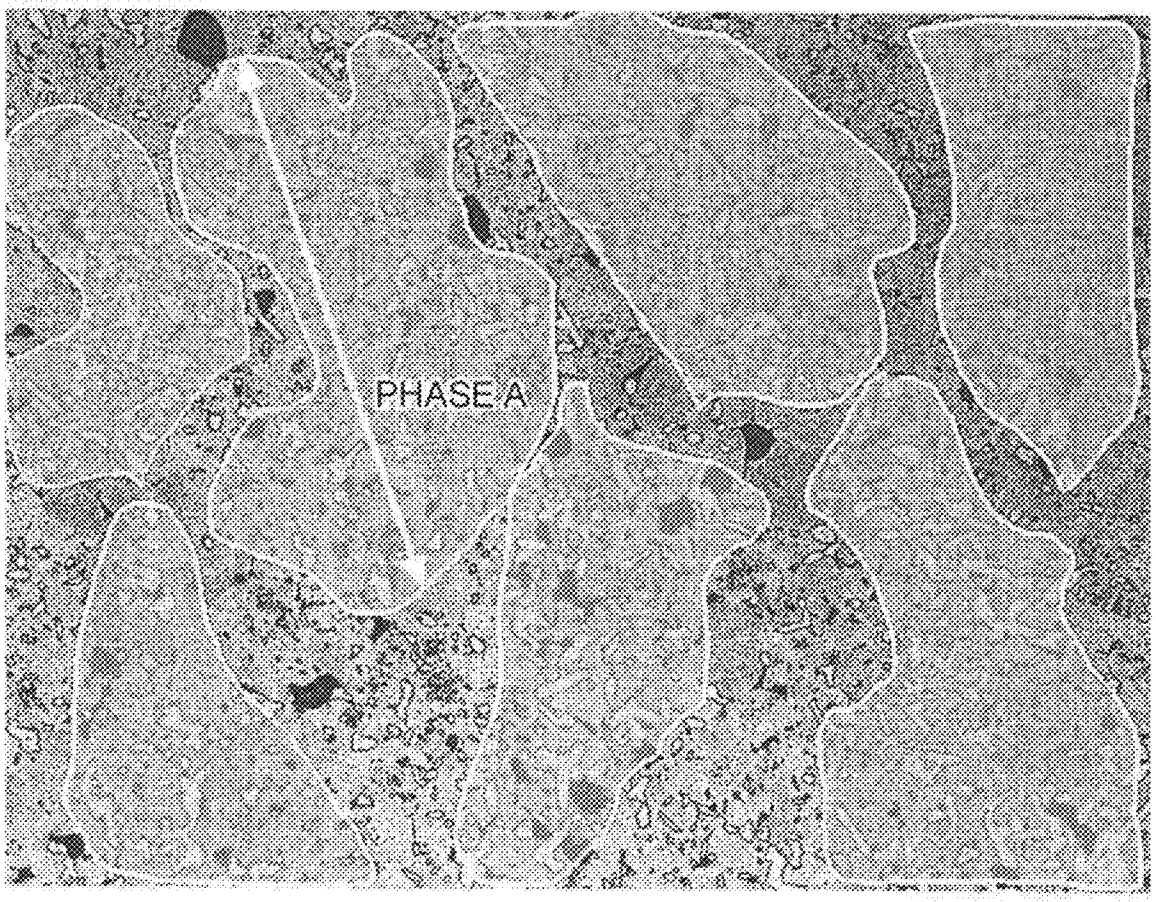
FIG. 2 is a view showing the area of the phase A in the metallic structure photograph.

The cross sections of the sintered samples in the shape of pillar were mirror-polished and corroded with royal water (sulfuric acid:nitric acid=1:3) so that the metallic structures of the cross sections of the sintered samples were observed by a microscope of 200 magnifications and analyzed in image by an image processor (WinROOF, made by MITANI CORPORATION) so as to measure the particle diameters of carbide in each of the phases and calculate the average particle diameters thereof, and so as to measure the areas and dimensions of the phase A and calculate the area ratio and maximum dimension thereof. FIG. 1 is a metallic structure photograph of the sintered sample 06. As shown in FIG. 2, the areas where the larger carbide was dispersed were enclosed and the thus enclosed areas were defined as the respective phases A. Then, the area ratio of the phase A was calculated and the maximum length of the phase A was defined as the maximum diameter in the phase A.

The sintered samples were heated at a temperature of 700° C. so as to investigate the thermal expansion coefficients thereof. Moreover, the sintered samples were heated within a temperature range of 850 to 950° C. for 100 hours under atmosphere so as to investigate the increases in weight thereof after heating. The results were listed in Table 2.

Then, the sintered samples in the shape of thin plate were used as disc members and tested in abrasion by using a rolling member with an outer diameter of 15 mm and a length of 22 mm and made of chromized JIS SUS 316L as the opponent member under the roll-on-disc abrasion test where the sintered samples were slid repeatedly on the rolling member at a temperature of 700° C. during 15 minutes. The abrasion results were also listed in Table 2.

Then, the sintered samples in the shape of square plate were tested in salt water splaying by continuously splaying 5%-NaCl aqueous solution thereto at a temperature of 35° C. for 200 hours using STP-90V2 made by Suga Test Instruments Co., Ltd. After the salt water splaying test, the surfaces of the sintered samples were analyzed in image by the image processor (WinROOF, made by MITANI CORPORATION) so as to measure the respective areas of the positions where rusts occur and calculate the respective ratios of the corresponding rust areas to the total surface area of the sintered sample as "corrosion area ratio"s.

Note that the sintered samples having the thermal expansion coefficients of $16\times10^{-6}K^{-1}$ or more, the abrasion depth of 2 μm or less, the weight increase due to oxidization of 10 $g/m^2$ or less at a temperature of 850° C., 15 $g/m^2$ or less at a temperature of 900° C. and 20 $g/m^2$ or less at a temperature of 950° C. pass the aforementioned tests.

TABLE 1

| | MIXING RATIO, MASS % | | | | | |
|---|---|---|---|---|---|---|
| SINTERED SAMPLE | IRON ALLOY POWDER A | IRON ALLOY POWDER B | NICKEL POWDER | IRON-PHOSPHOROUS ALLOY POWDER | COPPER POWDER | GRAPHITE POWDER |
| 01 | 0.0 | 85.0 | 5.0 | 3.0 | 6.0 | 1.0 |
| 02 | 8.5 | 76.5 | 5.0 | 3.0 | 6.0 | 1.0 |
| 03 | 17.0 | 68.0 | 5.0 | 3.0 | 6.0 | 1.0 |
| 04 | 25.5 | 59.5 | 5.0 | 3.0 | 6.0 | 1.0 |
| 05 | 34.0 | 51.0 | 5.0 | 3.0 | 6.0 | 1.0 |
| 06 | 42.5 | 42.5 | 5.0 | 3.0 | 6.0 | 1.0 |
| 07 | 51.0 | 34.0 | 5.0 | 3.0 | 6.0 | 1.0 |
| 08 | 59.5 | 25.5 | 5.0 | 3.0 | 6.0 | 1.0 |
| 09 | 68.0 | 17.0 | 5.0 | 3.0 | 6.0 | 1.0 |

TABLE 1-continued

| | | | | | | |
|---|---|---|---|---|---|---|
| 10 | 76.5 | 8.5 | 5.0 | 3.0 | 6.0 | 1.0 |
| 11 | 85.0 | 0.0 | 5.0 | 3.0 | 6.0 | 1.0 |

| SINTERED | | COMPOSITION, MASS % | | | | | | |
|---|---|---|---|---|---|---|---|---|
| SAMPLE | A/B | Fe | Cr | Ni | Si | P | C | Cu |
| 01 | 0 | BALANCE | 15.30 | 11.80 | 0.00 | 0.60 | 0.80 | 6.00 |
| 02 | 10 | BALANCE | 16.66 | 11.97 | 0.17 | 0.60 | 0.97 | 6.00 |
| 03 | 20 | BALANCE | 18.02 | 12.14 | 0.34 | 0.60 | 1.14 | 6.00 |
| 04 | 30 | BALANCE | 19.38 | 12.31 | 0.51 | 0.60 | 1.31 | 6.00 |
| 05 | 40 | BALANCE | 20.74 | 12.48 | 0.68 | 0.60 | 1.46 | 6.00 |
| 06 | 50 | BALANCE | 20.10 | 12.65 | 0.85 | 0.60 | 1.65 | 6.00 |
| 07 | 60 | BALANCE | 23.46 | 12.82 | 1.02 | 0.60 | 1.82 | 6.00 |
| 08 | 70 | BALANCE | 24.82 | 12.99 | 1.19 | 0.60 | 1.99 | 6.00 |
| 09 | 80 | BALANCE | 26.18 | 13.16 | 1.38 | 0.60 | 2.16 | 6.00 |
| 10 | 90 | BALANCE | 27.54 | 13.33 | 1.53 | 0.60 | 2.33 | 6.00 |
| 11 | 100 | BALANCE | 28.90 | 13.50 | 1.70 | 0.60 | 2.50 | 6.00 |

TABLE 2

| SINTERED | AVERAGE PARTICLE DIAMETER OF CARBIDE [μm] | | AREA RATIO OF PHASE | MAXIMUM DIAMETER OF PHASE | THERMAL EXPANSION COEFFICIENT, | AVERAGE ABRASION DEPTH, | INCREASE IN WEIGHT DUE TO OXIDIZATION, $g/m^2$ | | |
|---|---|---|---|---|---|---|---|---|---|
| SAMPLE | PHASE A | PHASE B | A, % | A, μm | $10^{-6}K^{-1}$ | μm | 850° C. | 900° C. | 950° C. |
| 01 | — | 2 | 0 | — | 17.8 | 3.6 | 15 | 25 | 31 |
| 02 | 13 | 2 | 10 | 240 | 17.5 | 2.4 | 12 | 19 | 25 |
| 03 | 14 | 3 | 22 | 250 | 17.4 | 1.5 | 9 | 13 | 19 |
| 04 | 14 | 3 | 37 | 260 | 17.3 | 1.3 | 6 | 9 | 16 |
| 05 | 15 | 3 | 46 | 270 | 16.9 | 1.2 | 4 | 7 | 13 |
| 06 | 15 | 3 | 53 | 280 | 16.7 | 1.2 | 3 | 6 | 10 |
| 07 | 16 | 3 | 61 | 290 | 16.5 | 1.2 | 2 | 5 | 9 |
| 08 | 17 | 4 | 63 | 290 | 16.4 | 1.3 | 2 | 4 | 8 |
| 09 | 18 | 4 | 78 | 300 | 16.3 | 1.4 | 2 | 4 | 9 |
| 10 | 18 | 6 | 88 | 350 | 16.2 | 2.1 | 4 | 9 | 13 |
| 11 | 19 | — | 95 | 600 | 16.1 | 2.3 | 7 | 14 | 25 |

| SINTERED SAMPLE | CORROSION AREA RATIO % | NOTE |
|---|---|---|
| 01 | 27 | AREA RATIO OF PHASE A LESS THAN LOWER UNITED VALUE |
| 02 | 22 | AREA RATIO OF PHASE A LESS THAN LOWER UNITED VALUE |
| 03 | 14 | AREA RATIO OF PHASE A EQUAL TO LOWER LIMITED VALUE |
| 04 | 12 | |
| 05 | 7 | |
| 06 | 5 | |
| 07 | 6 | |
| 08 | 7 | |
| 09 | 7 | AREA RATIO OF PHASE A EQUAL TO UPPER LIMITED VALUE |
| 10 | 8 | AREA RATIO OF PHASE A MORE THAN UPPER LIMITED VALUE |
| 11 | 10 | AREA RATIO OF PHASE A MORE THAN UPPER LIMITED VALUE |

The effect/function of the ratio of the iron alloy powder A and the iron alloy powder B can be recognized from Tables. 1 and 2. In the sintered sample 01 not containing the iron alloy powder A so that the ratio (A/A+B) of the iron alloy powder A to the total of the iron alloy powder A and the iron alloy powder B is set to zero, no phase A containing the larger dispersed carbide, which is made of the iron alloy powder A, exists. Hence, the sintered sample 01 exhibits a thermal expansion coefficient of $17.7\times10^{-6}K^{-1}$ similar to that of an austenitic heat-resistant material. However, since the iron alloy powder B contains a smaller amount of chromium and no carbon, the size of the precipitated carbide in the sintered sample 01 becomes small at 2 μm and thus the abrasion depth of the sintered sample 01 becomes large beyond 2 μm. Moreover, since the content of chromium relative to the composition of the sintered sample 01 is in short, chromium contained in the sintered sample 01 is partially precipitated as chromium carbide so that the content of chromium solid-solved in the sintered sample 01 becomes insufficient. Consequently, the sintered sample 01 is increased in weight due to oxidization and deteriorated in corrosion resistance.

In the sintered sample 11 not containing the iron alloy powder B so that the ratio (A/A+B) of the iron alloy powder A to the total of the iron alloy powder A and the iron alloy powder B is set to 100%, only the phase A containing the larger dispersed carbide with an average diameter of 19 μm, which is made of the iron alloy powder A, exists while the phase B containing the smaller dispersed carbide, which is made of the iron alloy powder B, does not exist at all. Hence, the thermal expansion coefficient of the sintered sample 11 is decreased to $16.1\times10^{-6}K^{-1}$, but still similar to that of an austenitic heat-resistant material, so that the sintered sample 11 has a thermal expansion coefficient enough to be practically applied. Moreover, since only the iron alloy powder A containing larger amounts of chromium and carbon is used for the manufacture of the sintered sample 11 and the carbon is additionally added to the sintered sample 11 by supplying the graphite powder to the iron alloy powder A, the content of the carbide precipitated in the base material of the sintered sample 11 is increased, resulting in the increase of attack on the opponent component (rolling member). As the result that the abrasion powder of the opponent component serves as abrading agent, the abrasion depth of the sintered sample 11 is increased. Furthermore, the amount of chromium to be solid solved in the base material of the sintered sample 11 becomes insufficient as the amount of the chromium carbide precipitated in the base material is increased so that the sintered sample 11 is increased in weight due to oxidization, resulting in the deterioration of the corrosion resistance of the sintered sample 11 (refer to samples 01 to 11 in Tables 1 and 2).

In the sintered samples 02 to 10 made of the mixture of the iron alloy powder A and the iron alloy powder B, the phase A containing the larger dispersed carbide within an average diameter range of 14 to 18 μm is dispersed so that the sintered samples 02 to 10 exhibit the respective metallic structures such that the ratio of the phase A to the total of the phase A and the phase B is increased as the ratio of the iron alloy powder A to the total of the iron alloy powder A and the iron alloy powder B is increased. Moreover, the thermal expansion coefficients of the sintered samples 02 to 10 are likely to be decreased as the ratio of the phase A therein is increased. However, since the sintered samples 02 to 10 exhibit $16\times10^{-6}K^{-1}$ still similar to that of an austenitic heat-resistant material, the sintered samples 02 to 10 have the respective thermal expansion coefficients enough to be practically applied.

FIG. 1 is a metallic structure photograph of the sintered sample 06. As is apparent from FIG. 1, it is turned out that the sintered sample 06 has the metallic structure such that the phase A containing the larger dispersed carbide with an average particle diameter of 17 m is randomly dispersed in the phase B containing the smaller dispersed carbide with an average particle diameter of 4 μm.

The abrasion depths of the sintered samples are likely to be decreased due to the increases in corrosion resistance thereof as the ratio of the phase A containing the larger dispersed carbide is increased, which is originated from that the increase of the ratio of the phase A containing the larger dispersed carbide causes the decrease of the phase B containing the smaller dispersed carbide and the increase of attack on the opponent component (rolling member) so that the abrasion powder of the opponent component serves as the abrading agent so as to increase the abrasion depths of the sintered samples.

Moreover, as the result that the amounts of chromium in the sintered samples are entirely increased as the ratio of the iron alloy powder A containing a larger amount of chromium is increased and the ratio of the iron alloy powder B containing a smaller amount of chromium is decreased, the large amount of the chromium is solid-solved in the base materials of the corresponding sintered samples so as to enhance the corrosion resistances thereof and decrease the weights thereof due to oxidization even though the precipitation amount of the chromium carbide is increased (refer to samples 01 to 06). However, if the ratio of the iron alloy powder A is more than 50%, the amount of carbon to be contained in the mixture of the iron alloy powder A and the iron alloy powder B is increased as the ratio of the iron alloy powder A is increased, causing the increases in precipitation of the chromium carbide and the shortage of the amount of chromium to be solid-solved in the base materials of the sintered samples, and thus causing the increases in weight of the sintered samples due to oxidization and the decreases in corrosion resistance of the sintered samples (refer to samples 07 to 11).

In view of the aforementioned wear resistance and corrosion resistance, it is preferable that the ratio of the phase A is set within a range of 20 to 80% relative to the base material of the sintered samples by setting the ratio (A/A+B) of the iron alloy powder A to the total of the iron alloy powder A and the iron alloy powder B within a range of 20 to 80%, which causes the enhancement of the wear resistance and corrosion resistance of each of the sintered samples. More preferably, the ratio of the (A/A+B) of the iron alloy powder A to the total of the iron alloy powder A and the iron alloy powder B is set within a range of 40 to 60% so that the ratio of the phase A is set within a range of 40 to 60% relative to the base material of the sintered samples.

Example 2

The iron alloy powders A having the respective components shown in Table 3 were prepared, and mixed with the iron alloy powder B, the iron-phosphorus alloy powder, the nickel powder, the copper powder and the graphite powder which were used in Example 1 at the ratios shown in Table 3 to blend the respective raw material powders. The thus obtained raw material powders were compressed and sintered respectively in the same manner as in Example 1 to form sintered samples 12 to 30 in the shape of pillar, in the shape of square pillar and in the shape of thin plate. The total components of the sintered samples were listed in Table 3. With respect to the sintered samples, the average particle diameter of carbide in the phase A and the phase B, the ratio of the phase A, the maximum dimension of the phase A, the thermal expansion coefficient, the increase in weight after oxidizing test, the corrosion area ratio and the abrasion depth after roll-on-disc abrasion test were measured in the same manner as in Example 1. The results were listed in Table 4 with the results of the sintered sample 06 obtained in Example 1.

TABLE 3

| SINTERED SAMPLE | MIXING RATIO, MASS % | | | | | | | | | | |
|---|---|---|---|---|---|---|---|---|---|---|---|
| | IRON ALLOY POWDER A | COMPOSITION, MASS % | | | | | IRON ALLOY POWDER B | NICKEL POWDER | IRON-PHOSPHOROUS ALLOY POWDER | COPPER POWDER | GRAPHITE POWDER |
| | | Fe | Cr | Ni | Si | C | | | | | |
| 12 | 42.5 | BALANCE | 20.0 | 10.0 | 2.0 | 2.0 | 42.5 | 5.0 | 3.0 | 6.0 | 1.0 |
| 13 | 42.5 | BALANCE | 25.0 | 10.0 | 2.0 | 2.0 | 42.5 | 5.0 | 3.0 | 6.0 | 1.0 |
| 14 | 42.5 | BALANCE | 30.0 | 10.0 | 2.0 | 2.0 | 42.5 | 5.0 | 3.0 | 6.0 | 1.0 |
| 06 | 42.5 | BALANCE | 34.0 | 10.0 | 2.0 | 2.0 | 42.5 | 5.0 | 3.0 | 6.0 | 1.0 |
| 15 | 42.5 | BALANCE | 40.0 | 10.0 | 2.0 | 2.0 | 42.5 | 5.0 | 3.0 | 6.0 | 1.0 |
| 16 | 42.5 | BALANCE | 45.0 | 10.0 | 2.0 | 2.0 | 42.5 | 5.0 | 3.0 | 6.0 | 1.0 |
| 17 | 42.5 | BALANCE | 50.0 | 10.0 | 2.0 | 2.0 | 42.5 | 5.0 | 3.0 | 6.0 | 1.0 |
| 18 | 42.5 | BALANCE | 34.0 | 0.0 | 2.0 | 2.0 | 42.5 | 5.0 | 3.0 | 6.0 | 1.0 |
| 19 | 42.5 | BALANCE | 34.0 | 5.0 | 2.0 | 2.0 | 42.5 | 5.0 | 3.0 | 6.0 | 1.0 |
| 06 | 42.5 | BALANCE | 34.0 | 1.0 | 2.0 | 2.0 | 42.5 | 5.0 | 3.0 | 6.0 | 1.0 |
| 20 | 42.5 | BALANCE | 34.0 | 15.0 | 2.0 | 2.0 | 42.5 | 5.0 | 3.0 | 6.0 | 1.0 |
| 21 | 42.5 | BALANCE | 34.0 | 20.0 | 2.0 | 2.0 | 42.5 | 5.0 | 3.0 | 6.0 | 1.0 |
| 22 | 42.5 | BALANCE | 34.0 | 10.0 | 2.0 | 0.0 | 42.5 | 5.0 | 3.0 | 6.0 | 1.0 |
| 23 | 42.5 | BALANCE | 34.0 | 10.0 | 2.0 | 0.5 | 42.5 | 5.0 | 3.0 | 6.0 | 1.0 |
| 24 | 42.5 | BALANCE | 34.0 | 10.0 | 2.0 | 1.0 | 42.5 | 5.0 | 3.0 | 6.0 | 1.0 |
| 25 | 42.5 | BALANCE | 34.0 | 10.0 | 2.0 | 1.5 | 42.5 | 5.0 | 3.0 | 6.0 | 1.0 |
| 06 | 42.5 | BALANCE | 34.0 | 10.0 | 2.0 | 2.0 | 42.5 | 5.0 | 3.0 | 6.0 | 1.0 |
| 26 | 42.5 | BALANCE | 34.0 | 10.0 | 2.0 | 2.5 | 42.5 | 5.0 | 3.0 | 6.0 | 1.0 |
| 27 | 42.5 | BALANCE | 34.0 | 10.0 | 2.0 | 3.0 | 42.5 | 5.0 | 3.0 | 6.0 | 1.0 |
| 28 | 42.5 | BALANCE | 34.0 | 10.0 | 2.0 | 4.0 | 42.5 | 5.0 | 3.0 | 6.0 | 1.0 |
| 29 | 42.5 | BALANCE | 34.0 | 10.0 | 2.0 | 4.5 | 42.5 | 5.0 | 3.0 | 6.0 | 1.0 |
| 30 | 42.5 | BALANCE | 34.0 | 10.0 | 2.0 | 5.0 | 42.5 | 5.0 | 3.0 | 6.0 | 1.0 |

| SINTERED SAMPLE | A/B | COMPOSITION, MASS % | | | | | | |
|---|---|---|---|---|---|---|---|---|
| | | Fe | Cr | Ni | Si | P | C | Cu |
| 12 | 50 | BALANCE | 16.15 | 12.65 | 0.85 | 0.60 | 1.65 | 6.00 |
| 13 | 50 | BALANCE | 18.20 | 12.65 | 0.85 | 0.60 | 1.65 | 6.00 |
| 14 | 50 | BALANCE | 23.40 | 12.65 | 0.85 | 0.60 | 1.65 | 6.00 |
| 06 | 50 | BALANCE | 22.10 | 12.65 | 0.85 | 0.60 | 1.65 | 6.00 |
| 15 | 50 | BALANCE | 24.65 | 12.65 | 0.85 | 0.60 | 1.65 | 6.00 |
| 16 | 50 | BALANCE | 26.28 | 12.65 | 0.85 | 0.60 | 1.65 | 6.00 |
| 17 | 50 | BALANCE | 28.90 | 12.65 | 0.85 | 0.60 | 1.65 | 6.00 |
| 18 | 50 | BALANCE | 22.10 | 8.40 | 0.85 | 0.60 | 1.65 | 6.00 |
| 19 | 50 | BALANCE | 22.10 | 10.53 | 0.85 | 0.60 | 1.65 | 6.00 |
| 06 | 50 | BALANCE | 22.10 | 12.65 | 0.85 | 0.60 | 1.65 | 6.00 |
| 20 | 50 | BALANCE | 22.10 | 14.70 | 0.85 | 0.60 | 1.65 | 6.00 |
| 21 | 50 | BALANCE | 22.10 | 15.90 | 0.85 | 0.60 | 1.85 | 6.00 |
| 22 | 50 | BALANCE | 22.10 | 12.65 | 0.85 | 0.60 | 0.30 | 6.00 |
| 23 | 50 | BALANCE | 22.10 | 12.65 | 0.85 | 0.60 | 1.01 | 6.00 |
| 24 | 50 | BALANCE | 22.10 | 12.65 | 0.85 | 0.60 | 1.23 | 6.00 |
| 25 | 50 | BALANCE | 22.10 | 12.65 | 0.85 | 0.60 | 1.44 | 6.00 |
| 06 | 50 | BALANCE | 22.10 | 12.65 | 0.85 | 0.60 | 1.55 | 6.00 |
| 26 | 50 | BALANCE | 22.10 | 12.65 | 0.85 | 0.60 | 1.26 | 6.00 |
| 27 | 50 | BALANCE | 22.10 | 12.65 | 0.85 | 0.60 | 2.08 | 6.00 |
| 28 | 50 | BALANCE | 22.10 | 12.65 | 0.85 | 0.60 | 2.50 | 6.00 |
| 29 | 50 | BALANCE | 22.10 | 12.65 | 0.85 | 0.60 | 2.71 | 6.00 |
| 30 | 50 | BALANCE | 22.10 | 12.65 | 0.85 | 0.60 | 2.93 | 6.00 |

TABLE 4

| SINTERED SAMPLE | AVERAGE PARTICLE DIAMETER OF CARBIDE [μm] | | AREA RATIO OF PHASE A, % | MAXIMUM DIAMETER OF PHASE A, μm | THERMAL EXPANSION COEFFICIENT, $10^{-6}K^{-1}$ | AVERAGE ABRASION DEPTH, μm | INCREASE IN WEIGHT DUE TO OXIDIZATION $g/m^2$ | | |
|---|---|---|---|---|---|---|---|---|---|
| | PHASE A | PHASE B | | | | | 850° C. | 900° C. | 950° C. |
| 12 | 8 | 3 | 30 | 220 | 17.4 | 2.1 | 13 | 21 | 27 |
| 13 | 12 | 3 | 36 | 240 | 17.3 | 1.5 | 8 | 12 | 19 |
| 14 | 15 | 3 | 48 | 260 | 17.0 | 1.3 | 4 | 8 | 14 |
| 06 | 15 | 3 | 53 | 280 | 16.7 | 1.2 | 3 | 6 | 10 |
| 15 | 19 | 4 | 55 | 290 | 16.3 | 1.2 | 2 | 5 | 8 |
| 16 | 21 | 4 | 57 | 300 | 16.2 | 1.4 | 2 | 4 | 6 |
| 17 | — | — | — | — | — | — | — | — | — |
| 18 | 16 | 3 | 54 | 280 | 14.1 | 1.5 | 2 | 5 | 9 |
| 19 | 16 | 3 | 53 | 270 | 18.2 | 1.3 | 3 | 6 | 10 |
| 06 | 15 | 3 | 53 | 280 | 16.7 | 1.2 | 3 | 6 | 10 |

TABLE 4-continued

| | | | | | | | | | |
|---|---|---|---|---|---|---|---|---|---|
| 20 | 15 | 2 | 52 | 280 | 16.8 | 1.2 | 3 | 6 | 10 |
| 21 | 15 | 2 | 53 | 270 | 17.2 | 1.3 | 3 | 6 | 10 |
| 22 | 3 | 1 | 35 | 150 | 15.9 | 3.4 | 11 | 18 | 35 |
| 23 | 10 | 2 | 43 | 200 | 16.2 | 1.5 | 9 | 14 | 19 |
| 24 | 12 | 2 | 46 | 230 | 16.4 | 1.3 | 6 | 12 | 16 |
| 25 | 15 | 2 | 50 | 260 | 16.6 | 1.2 | 3 | 9 | 13 |
| 06 | 15 | 3 | 53 | 280 | 16.7 | 1.2 | 3 | 6 | 10 |
| 26 | 17 | 3 | 56 | 310 | 16.7 | 1.2 | 3 | 6 | 9 |
| 27 | 21 | 4 | 57 | 320 | 16.7 | 1.2 | 4 | 8 | 16 |
| 28 | 29 | 5 | 60 | 340 | 16.8 | 1.2 | 8 | 14 | 19 |
| 29 | 32 | 7 | 66 | 350 | 16.8 | 1.2 | 12 | 16 | 24 |
| 30 | — | — | — | — | — | — | — | — | — |

| SINTERED SAMPLE | CORROSION AREA RATIO, % | NOTE |
|---|---|---|
| 12 | 24 | CONTENT OF Cr IN IRON ALLOY POWDER A LESS THAN LOWER LIMITED VALUE |
| 13 | 15 | CONTENT OF Cr IN IRON ALLOY POWDER A LESS THAN LOWER LIMITED VALUE |
| 14 | 7 | |
| 06 | 5 | |
| 15 | 3 | |
| 16 | 2 | CONTENT OF Cr IN IRON ALLOY POWDER A EQUAL TO UPPER LIMITED VALUE |
| 17 | — | CONTENT OF Cr IN IRON ALLOY POWDER A MORE THAN UPPER LIMITED VALUE |
| 18 | 7 | CONTENT OF Ni IN IRON ALLOY POWDER A LESS THAN LOWER LIMITED VALUE |
| 19 | 6 | |
| 06 | 5 | |
| 20 | 5 | |
| 21 | 5 | CONTENT OF Ni IN IRON ALLOY POWDER A MORE THAN UPPER LIMITED VALUE |
| 22 | 10 | CONTENT OF C IN IRON ALLOY POWDER A LESS THAN LOWER LIMITED VALUE |
| 23 | 8 | CONTENT OF C IN IRON ALLOY POWDER A EQUAL TO LOWER LIMITED VALUE |
| 24 | 5 | |
| 25 | 5 | |
| 06 | 5 | |
| 26 | 7 | |
| 27 | 7 | |
| 28 | 10 | CONTENT OF C IN IRON ALLOY POWDER A EQUAL TO UPPER LIMITED VALUE |
| 29 | 26 | CONTENT OF C IN IRON ALLOY POWDER A MORE THAN UPPER LIMITED VALUE |
| 30 | — | CONTENT OF C IN IRON ALLOY POWDER A MORE THAN UPPER LIMITED VALUE |

From the sintered samples 06 and 12 to 17 in Tables 3 and 4, it is recognized that the effect/function of the amount of chromium of the iron alloy powder A can be recognized. In the sintered sample 12 made of the iron alloy powder A containing 20 mass % of chromium, since the content of chromium contained in the iron alloy powder A is small, the size of the chromium carbide precipitated in the phase A becomes small within a range of less than 10 μm as average particle size, and the ratio of the phase A occupied in the base material is decreased because the chromium contained in the iron alloy powder A is diffused in the phase B made of the iron alloy powder B during sintering. Therefore, the wear resistance of the sintered sample 12 is decreased so that the abrasion depth becomes large within a range of more than 2 μm. In the phase A of the sintered sample 12 made of the iron alloy powder A containing the smaller amount of chromium, the content of chromium to be solid-solved in the phase A is decreased due to the precipitation of the chromium carbide, resulting in the deterioration in corrosion resistance of the phase A and thus the increase in weight due to oxidization.

On the other hand, in the sintered samples 06 and 13 to 16 made of the iron alloy powder A containing chromium within a range of 25 to 45 mass %, the amount of chromium is added sufficiently so that the larger carbide more than 10 μm is precipitated. The particle diameter of the chromium carbide is likely to be increased as the content of chromium contained in the iron alloy powder A is increased. Moreover, the ratio of the phase A and the maximum diameter of the phase A is also increased as the content of chromium contained in the iron alloy powder A is increased. The precipitation of the chromium carbide and the increase in ratio of the phase A cause the improvement in abrasion depth of the sintered samples within a range of 2 μm or less, which exhibits the decrease in abrasion depth of the sintered samples as the content of chromium contained in the iron alloy powder A is increased. In the sintered samples 06 and 13 to 16 made of the iron alloy powder A containing the chromium within a range of 25 to 45 mass %, moreover, the sufficient amount of the chromium is solid-solved in the phase, thereby enhancing the corrosion resistances in the phase A of the sintered samples and thus reducing the increases of the sintered samples in weight due to oxidization. Namely, the increases in weight due to oxidization and the corrosion area ratios of the sintered samples can be more reduced with the increase of the amount of the chromium contained in the iron alloy powder A.

However, the hardness of the iron alloy powder A is increased as the content of the chromium contained in the iron alloy powder A is increased, and in the sintered sample 17 made of the iron alloy powder A containing 45 mass % or more of the chromium, the iron alloy powder A becomes too hard and cannot be compressed in the corresponding compressing process, and cannot be shaped.

Since the thermal expansion coefficients of the sintered samples are likely to be decreased as the content of the chromium is increased, and even the sintered sample 16, made of the iron alloy powder A containing 45 mass % of the chromium, has a practically usable one of more than $16\times10^{-6}K^{-1}$.

In this manner, it is confirmed that the particle size of the metallic carbide in the phase A is required to be more than 10 μm. Moreover, it is confirmed that the content of the chromium contained in the iron alloy powder A forming the phase A should be set within a range of 25 to 45 mass %.

Referring to the sintered samples 06 and 18 to 21 shown in Tables 3 and 4, the influence of nickel contained in the iron alloy powder A can be recognized. In the sintered sample 18 made of the iron alloy powder A not containing nickel, the nickel powder is added to the iron alloy powder A as described above, but the nickel element of the nickel powder is not perfectly diffused into the inner area of the iron alloy powder A so that the phase A is not partially austenitized and the not austenitized areas locally remains in the phase A, thereby decreasing the thermal expansion coefficient within a range of less than $16\times10^{-6}K^{-1}$.

In the sintered samples 06 and 19 to 21 made of the iron alloy particles A containing 5 mass % or more of nickel, however, the amount of nickel enough to be austenitized is contained so that the phase A, made of the iron alloy powder A, is perfectly austenitized, so that the sintered samples have the respective practically usable thermal expansion coefficients of more than $16\times10^{-6}K^{-1}$.

The nickel element contained in the iron alloy powder A does not affect the size of the carbide in the phase A, the ratio of the phase A, the maximum diameter of the phase A, the sample abrasion depth and the increase in weight of the sample due to oxidization.

In this manner, it is confirmed that the content of the nickel contained in the iron alloy powder A should be set within a range of 5 mass % or more. Since the nickel is expensive, however, the excess use of the nickel results in the increase in cost of the samples, that is, the sintered alloy of the present invention, so that the content of the nickel contained in the iron alloy powder A should be set within a range of 15 mass % or less.

Referring to the sintered samples 06 and 22 to 30 shown in Tables 3 and 4, the influence of carbon contained in the iron alloy powder A can be recognized. In the sintered sample 22 made of the iron alloy powder A not containing carbon, the particle size of the chromium carbide precipitated in the phase A made of the iron alloy powder A is miniaturized within a range of 10 mu or less so that the difference in particle size between the chromium carbide precipitated in the phase A and the carbide precipitated in the phase B becomes small, resulting in the deterioration of the wear resistance of the sintered sample and in the abrasion depth of more than 2 μm of the sintered sample.

On the other hand, in the sintered sample 23 made of the iron alloy powder A containing 0.5 mass % of carbon, the particle size of the chromium carbide precipitated in the phase A becomes about 10 μm so that the difference in particle size between the chromium carbide precipitated in the phase A and the carbide precipitated in the phase B is increased up to 8 μm or so, causing the enhancement of the wear resistance of the sintered sample and decreasing the abrasion depth of the sintered sample within a range of 2 μm or less. Moreover, the particle size of the chromium carbide precipitated in the phase A made of the iron alloy powder A is increased while the carbon elements of the iron alloy powder A are diffused into the iron alloy powder B so that the ratio of the phase A and the maximum diameter of the phase A are likely to be increased as the content of the carbon contained in the iron alloy powder A is increased. Simultaneously, the wear resistances of the sintered samples are enhanced and thus the abrasion depths of the sintered samples are decreased as the content of the carbon contained in the iron alloy powder A is increased.

However, as the result that the content of the chromium solid-solved in the phase A is decreased as the particle size of the chromium carbide precipitated in the phase A is increased, the increases in weight of the sintered samples due to oxidization are gradually developed. In the sintered sample 29 made of the iron alloy powder A containing 4.5 mass % of carbon, therefore, the increase in weight of the sintered sample due to oxidization is developed up to more than 10 $g/m^2$ at a temperature of 850° C., up to more than 15 $g/m^2$ at a temperature of 900° C. and up to more than 20 $g/m^2$ at a temperature of 950° C. In the sintered sample 30 made of the iron alloy powder A containing 5 mass % of carbon, moreover, the iron alloy powder A becomes too hard, cannot be compressed in the corresponding compressing process and cannot be shaped.

As the result that the particle size of the chromium carbide precipitated in the phase A is increased so that the amount of the chromium to be solid-solved in the phase A is decreased as the content of the carbon contained in the iron alloy powder A is increased, the thermal expansion coefficients of the sintered samples are gradually increased up to more than $16\times10^{-6}K^{-1}$, which corresponds to the one practically usable, within a carbon content range of 0 to 4 mass %.

In this manner, it is confirmed that the particles size of the metallic carbide of the phase A is required to be within a range of 10 μm or more and the content of the carbon of the iron alloy powder A forming the phase A should be set within a range of 0.5 to 4 mass %.

Example 3

The iron alloy powders B having the respective compositions shown in Table 5 were prepared, and mixed with the iron alloy powder A, the iron-phosphorus alloy powder, the nickel powder, the copper powder and the graphite powder which were used in Example 1 at the ratios shown in Table 5 to blend the respective raw material powders. The thus obtained raw material powders were compressed and sintered in the same manner as in Example 1 to form sintered samples 31 to 41 in the shape of pillar, in the square pillar and in the shape of thin plate. The compositions of the sintered samples were listed in Table 5. With respect to the sintered samples, the average particle diameter of carbide in the phase A and the phase B, the ratio of the phase A, the maximum dimension of the phase A, the thermal expansion coefficients, the increases in weight after oxidizing test, the corrosion area ratio and the abrasion depth after roll-on-disc abrasion test were measured in the same manner as in Example 1. The results were listed in Table 6 with the results of the sintered sample 06 obtained in Example 1.

TABLE 5

| SINTERED SAMPLE | MIXING RATIO, MASS % | | | | | | | | |
|---|---|---|---|---|---|---|---|---|---|
| | IRON ALLOY POWDER A | IRON ALLOY POWDER B | COMPOSITION, MASS % | | | NICKEL POWDER | IRON-PHOSPHOROUS ALLOY POWDER | COPPER POWDER | GRAPHITE POWDER |
| | | | Fe | Cr | Ni | | | | |
| 31 | 42.5 | 42.5 | BALANCE | 10.0 | 8.0 | 5.0 | 3.0 | 6.0 | 1.0 |
| 32 | 42.5 | 42.5 | BALANCE | 12.0 | 8.0 | 5.0 | 3.0 | 6.0 | 1.0 |
| 33 | 42.5 | 42.5 | BALANCE | 15.0 | 8.0 | 5.0 | 3.0 | 6.0 | 1.0 |
| 06 | 42.5 | 42.5 | BALANCE | 18.0 | 8.0 | 5.0 | 3.0 | 6.0 | 1.0 |
| 34 | 42.5 | 42.5 | BALANCE | 20.0 | 8.0 | 5.0 | 3.0 | 6.0 | 1.0 |
| 35 | 42.5 | 42.5 | BALANCE | 25.0 | 8.0 | 5.0 | 3.0 | 6.0 | 1.0 |
| 36 | 42.5 | 42.5 | BALANCE | 30.0 | 8.0 | 5.0 | 3.0 | 6.0 | 1.0 |
| 37 | 42.5 | 42.5 | BALANCE | 18.0 | 0.0 | 5.0 | 3.0 | 6.0 | 1.0 |
| 38 | 42.5 | 42.5 | BALANCE | 18.0 | 5.0 | 5.0 | 3.0 | 6.0 | 1.0 |
| 06 | 42.5 | 42.5 | BALANCE | 18.0 | 8.0 | 5.0 | 3.0 | 6.0 | 1.0 |
| 39 | 42.5 | 42.5 | BALANCE | 18.0 | 10.0 | 5.0 | 3.0 | 6.0 | 1.0 |
| 40 | 42.5 | 42.5 | BALANCE | 18.0 | 15.0 | 5.0 | 3.0 | 6.0 | 1.0 |
| 41 | 42.5 | 42.5 | BALANCE | 18.0 | 20.0 | 5.0 | 3.0 | 6.0 | 1.0 |

| SINTERED SAMPLE | A/B | COMPOSITION, MASS % | | | | | | |
|---|---|---|---|---|---|---|---|---|
| | | Fe | Cr | Ni | Si | P | C | Cu |
| 31 | 50 | BALANCE | 18.70 | 12.65 | 0.85 | 0.60 | 1.65 | 6.00 |
| 32 | 50 | BALANCE | 19.55 | 12.65 | 0.85 | 0.60 | 1.65 | 6.00 |
| 33 | 50 | BALANCE | 20.83 | 12.65 | 0.85 | 0.60 | 1.65 | 6.00 |
| 06 | 50 | BALANCE | 22.10 | 12.65 | 0.85 | 0.60 | 1.65 | 6.00 |
| 34 | 50 | BALANCE | 22.95 | 12.65 | 0.85 | 0.60 | 1.65 | 6.00 |
| 35 | 50 | BALANCE | 25.08 | 12.65 | 0.85 | 0.60 | 1.65 | 6.00 |
| 36 | 50 | BALANCE | 27.20 | 12.65 | 0.85 | 0.60 | 1.66 | 6.00 |
| 37 | 50 | BALANCE | 22.10 | 9.25 | 0.85 | 0.60 | 1.67 | 6.00 |
| 38 | 50 | BALANCE | 22.10 | 11.38 | 0.85 | 0.60 | 1.68 | 6.00 |
| 06 | 50 | BALANCE | 22.10 | 12.65 | 0.85 | 0.60 | 1.69 | 6.00 |
| 39 | 50 | BALANCE | 22.10 | 13.50 | 0.85 | 0.60 | 1.70 | 6.00 |
| 40 | 50 | BALANCE | 22.10 | 15.63 | 0.85 | 0.60 | 1.71 | 6.00 |
| 41 | 50 | BALANCE | 22.10 | 17.75 | 0.85 | 0.60 | 0.30 | 6.00 |

TABLE 6

| SINTERED SAMPLE | AVERAGE PARTICLE DIAMETER OF CARBIDE [μm] | | AREA RATIO OF PHASE | MAXIMUM DIAMETER OF PHASE | THERMAL EXPANSION COEFFICIENT, | AVERAGE ABRASION DEPTH, | INCREASE IN WEIGHT DUE TO OXIDIZATION $g/m^2$ | | |
|---|---|---|---|---|---|---|---|---|---|
| | PHASE A | PHASE B | A, % | A, μm | $10^{-6}K^{-1}$ | μm | 850° C. | 900° C. | 950° C. |
| 31 | 14 | 2 | 43 | 300 | 17.0 | 2.1 | 12 | 18 | 22 |
| 32 | 14 | 2 | 49 | 290 | 16.9 | 1.4 | 9 | 14 | 18 |
| 33 | 15 | 2 | 51 | 290 | 16.8 | 1.3 | 5 | 9 | 14 |
| 06 | 15 | 3 | 53 | 280 | 16.7 | 1.2 | 3 | 6 | 10 |
| 34 | 15 | 3 | 53 | 280 | 16.5 | 1.2 | 3 | 5 | 8 |
| 35 | 15 | 7 | 53 | 270 | 16.1 | 1.5 | 2 | 5 | 7 |
| 36 | 15 | 12 | 52 | 260 | 15.8 | 2.4 | 2 | 4 | 7 |
| 37 | 15 | 3 | 54 | 300 | 15.7 | 2.1 | 5 | 8 | 14 |
| 38 | 15 | 3 | 54 | 290 | 16.3 | 1.4 | 4 | 7 | 12 |
| 06 | 15 | 3 | 53 | 280 | 16.7 | 1.2 | 3 | 6 | 10 |
| 39 | 14 | 3 | 53 | 28 | 16.7 | 1.2 | 3 | 6 | 10 |
| 40 | 14 | 3 | 53 | 270 | 16.8 | 1.5 | 3 | 6 | 10 |
| 41 | 14 | 3 | 52 | 270 | 16.8 | 2.8 | 3 | 7 | 11 |

| SINTERED SAMPLE | CORROSION AREA RATIO, % | NOTES |
|---|---|---|
| 31 | 22 | CONTENT OF Cr IN IRON ALLOY POWDER B LESS THAN LOWER LIMITED VALUE |
| 32 | 15 | CONTENT OF Cr IN IRON ALLOY POWDER B EQUAL TO LOWER LIMITED VALUE |
| 33 | 9 | |
| 06 | 5 | |
| 34 | 4 | |

TABLE 6-continued

| | | |
|---|---|---|
| 35 | 3 | CONTENT OF Cr IN IRON ALLOY POWDER B EQUAL TO UPPER LIMITED VALUE |
| 36 | 2 | CONTENT OF Cr IN IRON ALLOY POWDER B MORE THAN UPPER LIMITED VALUE |
| 37 | 6 | CONTENT OF Ni IN IRON ALLOY POWDER B LESS THAN LOWER LIMITED VALUE |
| 38 | 6 | CONTENT OF Ni IN IRON ALLOY POWDER B EQUAL TO LOWER LIMITED VALUE |
| 06 | 5 | |
| 39 | 5 | |
| 40 | 5 | CONTENT OF Ni IN IRON ALLOY POWDER B EQUAL TO UPPER LIMITED VALUE |
| 41 | 4 | CONTENT OF Ni IN IRON ALLOY POWDER B MORE THAN UPPER LIMITED VALUE |

Referring to the sintered samples 06 and 31 to 36 shown in Tables 5 and 6, the influence of chromium contained in the iron alloy powder B can be recognized. In the sintered sample 31 made of the iron alloy powder B containing less than 12 mass % of chromium, since the content of chromium contained in the iron alloy powder B is small, the content of chromium contained in the phase B made of the iron alloy powder B is decreased so that the corrosion resistance of the phase B is decreased and thus the increase in weight of the sintered sample due to oxidization and the corrosion area ratio are developed. On the other hand, in the sintered sample 32 made of the iron alloy powder B containing 12 mass % of chromium, the amount of chromium is added sufficiently so that the increase in weight of the sintered sample due to oxidization and the corrosion area ratio are reduced. Moreover, the increase in weight due to oxidation and the corrosion area ratio of the sintered sample are likely to be reduced as the content of chromium contained in the iron alloy powder B is increased.

The particle size of the chromium carbide precipitated in the phase B is likely to be increased as the content of chromium contained in the iron alloy powder B is increased, and in the sintered sample 35 made of the iron alloy powder B containing 25 mass % of chromium, the particle size of the carbide precipitated in the phase B becomes about 7 μm, and in the sintered sample 36 made of the iron alloy powder B containing more than 25 mass % of chromium, the particle size of the carbide precipitated in the phase B becomes more than 12 μm.

The abrasion depths of the sintered samples are likely to be decreased as the particle size of the chromium carbide precipitated in the phase B is increased, but if the particle size of the chromium carbide precipitated in the phase B is more than 6 μm, the difference in particle diameter between the chromium carbide precipitated in the phase B and the carbide precipitated in the phase A becomes small so that the abrasion depth of the sintered sample is likely to be increased. In the sintered sample 36 containing the chromium carbide of more than 10 μm precipitated in the phase B, the difference in particle diameter between the chromium carbide precipitated in the phase B and the carbide precipitated in the phase A becomes smaller up to about 5 μm so that the abrasion depth of the sintered sample is remarkably increased.

The thermal expansion coefficient of the sintered sample is likely to be increased as the content of the chromium contained in the iron alloy powder B is increased, and in the sintered sample 36 made of the iron alloy powder B containing more than 25 mass % of the chromium, the thermal expansion coefficient becomes smaller than $16\times10^{-6}K^{-1}$.

In this manner, it is confirmed that the particles size of the metallic carbide in the phase B is required to be set to 10 μm or less and the content of the chromium contained in the iron alloy powder B forming the phase B should be set within a range of 12 to 25 mass %.

Referring to the sintered samples 06 and 37 to 41 shown in Tables 5 and 6, the influence of nickel contained in the iron alloy powder B can be recognized. In the sintered sample 37 made of the iron alloy powder B not containing nickel, the nickel powder is added to the iron alloy powder B as described above, but the nickel element of the nickel powder is not perfectly diffused into the inner area of the iron alloy powder B so that the phase B is not partially austenitized and the not austenitized area locally remains in the phase B, thereby decreasing the thermal expansion coefficient within a range of less than $16\times10^{-6}K^{-1}$.

In the sintered samples 06 and 38 to 41 made of the iron alloy particles B containing 5 mass % or more of nickel, however, the amount of nickel enough to be austenitized is contained in the iron alloy powder B so that the phase B, made of the iron alloy powder B, is perfectly austenitized and thus the sintered samples have the respective practically usable thermal expansion coefficients of more than $16\times10^{-6}K^{-1}$.

The nickel element contained in the iron alloy powder B does not affect the size of the carbide in the phase B, the increase in weight of the sample due to oxidization and the corrosion area ratio.

In this manner, it is confirmed that the content of the nickel contained in the iron alloy powder B should be set within a range of 5 mass % or more. Since the nickel is expensive, however, the excess use of the nickel results in the increases in cost of the samples, that is, the sintered alloy of the present invention, so that the content of the nickel contained in the iron alloy powder B should be set within a range of 15 mass % or less.

Example 4

The iron alloy powder A, the iron alloy powder B, the iron-phosphorus alloy powder, the nickel powder, the copper powder and the graphite powder, which were used in Example 1, were prepared and mixed with one another at the ratios shown in Table 7 to blend the respective raw material powders. The thus obtained raw material powders were compressed and sintered in the same manner as in Example 1 to form sintered samples 42 to 60 in the shape of pillar, in the shape of square pillar and in the shape of thin plate. The compositions of the sintered samples were listed in Table 7. With respect to the sintered samples, the average particle diameter of carbide in the phase A and the phase B, the ratio of the phase A, the maximum dimension of the phase A, the thermal expansion coefficients, the increase in weight after oxidizing test, the corrosion area ratio and the abrasion depth after roll-on-disc abrasion test were measured in the same manner as in Example 1. The results were listed in Table 8. In Tables 7 and 8, the results of the sintered sample 06 obtained in Example 1 were listed together.

TABLE 7

| | MIXING RATIO, MASS % | | | | | | |
|---|---|---|---|---|---|---|---|
| SINTERED SAMPLE | IRON ALLOY POWDER A | IRON ALLOY POWDER B | NICKEL POWDER | IRON-PHOSPHOROUS ALLOY POWDER | COPPER POWDER | GRAPHITE POWDER | A/B |
| 42 | 45.0 | 45.0 | 0.0 | 3.0 | 6.0 | 1.0 | 50 |
| 43 | 44.5 | 44.5 | 1.0 | 3.0 | 6.0 | 1.0 | 50 |
| 44 | 43.5 | 43.5 | 3.0 | 3.0 | 6.0 | 1.0 | 50 |
| 06 | 42.5 | 42.5 | 5.0 | 3.0 | 6.0 | 1.0 | 50 |
| 45 | 41.3 | 41.3 | 7.5 | 3.0 | 6.0 | 1.0 | 50 |
| 46 | 40.0 | 40.0 | 10.0 | 3.0 | 6.0 | 1.0 | 50 |
| 47 | 39.0 | 39.0 | 12.0 | 3.0 | 6.0 | 1.0 | 50 |
| 48 | 37.5 | 37.5 | 15.0 | 3.0 | 6.0 | 1.0 | 50 |
| 49 | 45.5 | 45.5 | 5.0 | 3.0 | 0.0 | 1.0 | 50 |
| 50 | 45.0 | 45.0 | 5.0 | 3.0 | 1.0 | 1.0 | 50 |
| 51 | 44.5 | 44.5 | 5.0 | 3.0 | 2.0 | 1.0 | 50 |
| 52 | 43.5 | 43.5 | 5.0 | 3.0 | 4.0 | 1.0 | 50 |
| 06 | 42.5 | 42.5 | 5.0 | 3.0 | 6.0 | 1.0 | 50 |
| 53 | 41.5 | 41.5 | 5.0 | 3.0 | 8.0 | 1.0 | 50 |
| 54 | 40.5 | 40.5 | 5.0 | 3.0 | 10.0 | 1.0 | 50 |
| 55 | 39.5 | 39.5 | 5.0 | 3.0 | 12.0 | 1.0 | 50 |
| 56 | 43.0 | 43.0 | 5.0 | 3.0 | 6.0 | 0.0 | 50 |
| 57 | 43.0 | 43.0 | 5.0 | 3.0 | 6.0 | 0.1 | 50 |
| 58 | 42.8 | 42.8 | 5.0 | 3.0 | 6.0 | 0.5 | 50 |
| 06 | 42.5 | 42.5 | 5.0 | 3.0 | 6.0 | 1.0 | 50 |
| 59 | 42.3 | 42.3 | 5.0 | 3.0 | 6.0 | 1.5 | 50 |
| 60 | 42.0 | 42.0 | 5.0 | 3.0 | 6.0 | 2.0 | 50 |
| 61 | 41.5 | 41.5 | 5.0 | 3.0 | 6.0 | 3.0 | 50 |
| 62 | 44.0 | 44.0 | 5.0 | 0.0 | 6.0 | 1.0 | 50 |
| 63 | 43.5 | 43.5 | 5.0 | 1.0 | 6.0 | 1.0 | 50 |
| 64 | 43.0 | 43.0 | 5.0 | 2.0 | 6.0 | 1.0 | 50 |
| 06 | 42.5 | 42.5 | 5.0 | 3.0 | 6.0 | 1.0 | 50 |
| 65 | 42.0 | 42.0 | 5.0 | 4.0 | 6.0 | 1.0 | 50 |
| 66 | 41.5 | 41.5 | 5.0 | 5.0 | 6.0 | 1.0 | 50 |
| 67 | 41.0 | 41.0 | 5.0 | 6.0 | 6.0 | 1.0 | 50 |

| SINTERED | COMPOSITION, MASS % | | | | | | |
|---|---|---|---|---|---|---|---|
| SAMPLE | Fe | Cr | Ni | Si | P | C | Cu |
| 42 | BALANCE | 23.40 | 8.10 | 0.90 | 0.60 | 1.70 | 6.00 |
| 43 | BALANCE | 23.14 | 9.01 | 0.89 | 0.60 | 1.69 | 6.00 |
| 44 | BALANCE | 22.02 | 10.83 | 0.87 | 0.60 | 1.67 | 6.00 |
| 06 | BALANCE | 22.10 | 12.65 | 0.85 | 0.60 | 1.65 | 6.00 |
| 45 | BALANCE | 21.45 | 14.93 | 0.83 | 0.60 | 1.63 | 6.00 |
| 46 | BALANCE | 20.80 | 17.20 | 0.80 | 0.60 | 1.60 | 6.00 |
| 47 | BALANCE | 20.28 | 19.02 | 0.78 | 0.60 | 1.58 | 6.00 |
| 48 | BALANCE | 19.50 | 21.75 | 0.75 | 0.60 | 1.55 | 6.00 |
| 49 | BALANCE | 23.65 | 13.10 | 0.91 | 0.60 | 1.71 | 0.00 |
| 50 | BALANCE | 23.40 | 13.10 | 0.90 | 0.60 | 1.70 | 1.00 |
| 51 | BALANCE | 23.14 | 13.01 | 0.89 | 0.60 | 1.69 | 2.00 |
| 52 | BALANCE | 22.62 | 12.83 | 0.87 | 0.60 | 1.67 | 4.00 |
| 06 | BALANCE | 22.10 | 12.65 | 0.85 | 0.60 | 1.65 | 6.00 |
| 53 | BALANCE | 21.58 | 12.47 | 0.83 | 0.60 | 1.63 | 8.00 |
| 54 | BALANCE | 21.06 | 12.20 | 0.87 | 0.60 | 1.61 | 10.00 |
| 55 | BALANCE | 20.54 | 12.11 | 0.79 | 0.60 | 1.59 | 12.00 |
| 56 | BALANCE | 22.38 | 12.74 | 0.86 | 0.60 | 0.66 | 6.00 |
| 57 | BALANCE | 22.33 | 12.73 | 0.86 | 0.60 | 0.76 | 6.00 |
| 58 | BALANCE | 22.23 | 12.70 | 0.88 | 0.60 | 1.16 | 6.00 |
| 06 | BALANCE | 22.10 | 12.65 | 0.85 | 0.60 | 1.65 | 6.00 |
| 59 | BALANCE | 21.97 | 12.61 | 0.85 | 0.60 | 2.15 | 6.00 |
| 60 | BALANCE | 21.84 | 12.56 | 0.84 | 0.60 | 2.64 | 6.00 |
| 61 | BALANCE | 21.58 | 12.47 | 0.83 | 0.60 | 3.63 | 6.00 |
| 62 | BALANCE | 22.80 | 12.92 | 0.88 | 0.00 | 1.68 | 6.00 |
| 63 | BALANCE | 22.62 | 12.83 | 0.87 | 0.20 | 1.67 | 6.00 |
| 64 | BALANCE | 22.36 | 12.74 | 0.88 | 0.40 | 1.66 | 6.00 |
| 06 | BALANCE | 22.10 | 12.66 | 0.85 | 0.60 | 1.65 | 6.00 |
| 65 | BALANCE | 21.84 | 12.56 | 0.84 | 0.80 | 1.64 | 6.00 |

TABLE 7-continued

| | | | | | | | |
|---|---|---|---|---|---|---|---|
| 66 | BALANCE | 21.58 | 12.47 | 0.83 | 1.00 | 1.63 | 6.00 |
| 67 | BALANCE | 21.32 | 12.38 | 0.82 | 1.20 | 1.62 | 6.00 |

TABLE 8

| SINTERED | AVERAGE PARTICLE DIAMETER OF CARBIDE [μm] | | AREA RATIO OF PHASE | MAXIMUM DIAMETER OF PHASE | THERMAL EXPANSION COEFFICIENT, | AVERAGE ABRASION DEPTH, | INCREASE IN WEIGHT DUE TO OXIDIZATION g/m$^2$ | | |
|---|---|---|---|---|---|---|---|---|---|
| SAMPLE | PHASE A | PHASE B | A, % | A, μm | $10^{-6}K^{-1}$ | μm | 850° C. | 900° C. | 950° C. |
| 42 | 18 | 3 | 54 | 290 | 15.5 | 2.4 | 4 | 7 | 10 |
| 43 | 17 | 3 | 54 | 290 | 16.0 | 1.4 | 4 | 7 | 10 |
| 44 | 17 | 3 | 54 | 280 | 16.4 | 1.3 | 4 | 7 | 10 |
| 06 | 15 | 3 | 53 | 280 | 16.7 | 1.2 | 3 | 6 | 10 |
| 45 | 15 | 3 | 53 | 280 | 16.8 | 1.2 | 3 | 6 | 10 |
| 46 | 14 | 3 | 52 | 270 | 16.9 | 1.3 | 3 | 5 | 9 |
| 47 | 14 | 3 | 52 | 270 | 17.0 | 1.4 | 3 | 5 | 9 |
| 48 | 14 | 3 | 52 | 270 | 17.2 | 4.5 | 3 | 6 | 9 |
| 49 | 12 | 2 | 47 | 220 | 16.5 | 1.8 | 3 | 5 | 8 |
| 50 | 12 | 2 | 48 | 230 | 16.5 | 1.5 | 3 | 5 | 8 |
| 51 | 13 | 2 | 48 | 250 | 16.5 | 1.4 | 3 | 5 | 8 |
| 52 | 14 | 3 | 50 | 270 | 16.5 | 1.4 | 3 | 6 | 8 |
| 06 | 15 | 3 | 53 | 280 | 16.7 | 1.2 | 3 | 6 | 10 |
| 53 | 15 | 4 | 54 | 280 | 16.6 | 1.3 | 5 | 9 | 15 |
| 54 | 17 | 5 | 55 | 290 | 16.7 | 1.8 | 7 | 13 | 18 |
| 55 | 20 | 8 | 57 | 300 | 16.8 | 2.4 | 13 | 17 | 24 |
| 56 | 5 | 1 | 42 | 170 | 15.8 | 5.8 | 6 | 16 | 24 |
| 57 | 11 | 2 | 45 | 190 | 16.2 | 1.8 | 5 | 12 | 18 |
| 58 | 13 | 3 | 48 | 240 | 16.5 | 1.6 | 4 | 8 | 15 |
| 06 | 15 | 3 | 43 | 380 | 16.7 | 1.2 | 3 | 6 | 10 |
| 59 | 17 | 4 | 54 | 300 | 16.7 | 1.2 | 3 | 6 | 10 |
| 60 | 25 | 6 | 56 | 320 | 16.5 | 1.1 | 4 | 8 | 12 |
| 61 | — | — | — | — | — | — | — | — | — |
| 62 | 8 | 2 | 53 | 180 | 16.7 | 2.9 | 14 | 18 | 25 |
| 63 | 12 | 2 | 52 | 240 | 16.6 | 1.8 | 8 | 13 | 17 |
| 64 | 13 | 3 | 52 | 260 | 16.7 | 1.4 | 5 | 9 | 13 |
| 06 | 15 | 3 | 53 | 280 | 16.7 | 1.2 | 3 | 6 | 10 |
| 65 | 17 | 3 | 53 | 290 | 16.6 | 1.2 | 2 | 5 | 8 |
| 66 | 19 | 4 | 55 | 300 | 16.6 | 1.7 | 6 | 13 | 16 |
| 67 | — | — | — | — | 16.6 | 3.4 | 12 | 17 | 28 |

| SINTERED SAMPLE | CORROSION AREA RATIO, % | NOTES |
|---|---|---|
| 42 | 8 | ADDITIONAL AMOUNT OF NICKEL POWDER LESS THAN LOWER LIMITED VALUE |
| 43 | 6 | ADDITIONAL AMOUNT OF NICKEL POWDER EQUAL TO LOWER LIMITED VALUE |
| 44 | 6 | |
| 06 | 5 | |
| 45 | 5 | |
| 46 | 5 | |
| 47 | 6 | ADDITIONAL AMOUNT OF NICKEL POWDER EQUAL TO UPPER LIMITED VALUE |
| 48 | 7 | ADDITIONAL AMOUNT OF NICKEL POWDER MORE THAN UPPER LIMITED VALUE |
| 49 | 25 | CONTENT OF Cu LESS THAN LOWER LIMITED VALUE |
| 50 | 14 | CONTENT OF Cu EQUAL TO LOWER LIMITED VALUE |
| 51 | 10 | |
| 52 | 8 | |
| 06 | 5 | |
| 53 | 6 | |
| 54 | 16 | CONTENT OF Cu EQUAL TO UPPER LIMITED VALUE |
| 55 | 26 | CONTENT OF Cu MORE THAN UPPER LIMITED VALUE |
| 56 | 24 | ADDITIONAL AMOUNT OF GRAPHITE POWDER LESS THAN LOWER LIMITED VALUE |

TABLE 8-continued

| | | |
|---|---|---|
| 57 | 13 | ADDITIONAL AMOUNT OF GRAPHITE POWDER EQUAL TO LOWER LIMITED VALUE |
| 58 | 8 | |
| 06 | 5 | |
| 59 | 6 | |
| 60 | 16 | ADDITIONAL AMOUNT OF GRAPHITE POWDER EQUAL TO UPPER LIMITED VALUE |
| 61 | — | ADDITIONAL AMOUNT OF GRAPHITE POWDER MORE THAN UPPER LIMITED VALUE |
| 62 | 30 | ADDITIONAL AMOUNT OF IRON-PHOSPHORUS ALLOY POWDER LESS THAN LOWER LIMITED VALUE |
| 63 | 18 | ADDITIONAL AMOUNT OF IRON-PHOSPHORUS ALLOY POWDER EQUAL TO LOWER LIMITED VALUE |
| 64 | 9 | |
| 06 | 5 | |
| 65 | 5 | |
| 66 | 88 | ADDITIONAL AMOUNT OF IRON-PHOSPHORUS ALLOY POWDER EQUAL TO UPPER LIMITED VALUE |
| 67 | 18 | ADDITIONAL AMOUNT OF IRON-PHOSPHORUS ALLOY POWDER MORE THAN UPPER LIMITED VALUE |

Referring to the sintered samples 06 and 42 to 48 shown in Tables 7 and 8, the influence in additive amount of the nickel powder can be recognized. In the sintered sample 42 not made of the nickel powder, the corresponding compact cannot be promoted in densification during the corresponding sintering process so that the density of the thus sintered sample is decreased (density ratio: 85%). The increase in weight of the sintered sample due to the oxidization is therefore relatively developed. Moreover, the strength of the sintered sample is decreased while the abrasion depth of the sintered sample is increased due to the low sintered density. In the sintered sample 42, the thermal expansion coefficient is decreased within a range of less than $16\times10^{-6}K^{-1}$ because the sintered sample is insufficiently austenitized due to the shortage of nickel in the sintered sample.

In the sintered sample 43 containing 1 mass % of the nickel powder, the densification of the sintered sample is promoted (density ratio: 90%) due to the addition of the nickel powder, thereby reducing the increase in weight of the sintered sample due to oxidization and thus decreasing the abrasion depth of the sintered sample. Moreover, the content of nickel contained in the sintered sample is increased so as to increase the thermal expansion coefficient up to $16\times10^{-6}K^{-1}$. In the sintered samples 06 and 44 to 48 made of the respective larger amounts of the nickel powder, the thermal expansion coefficients thereof are likely to be increased as the additive amount of the nickel powder is increased. The increases in weight of the sintered samples due to oxidization are reduced by the addition of the nickel powder, but the reduction effects for the increases in weight thereof are no longer developed within an additive amount of 3 mass % or more of the nickel powder.

If the nickel powder is excessively added, however, the nickel element not diffused during sintering remains as some nickel phase. The remaining nickel phase corresponds to a metallic structure having a low strength and wear resistance, and if the distribution amount of the remaining nickel phase is increased, the wear resistance of the corresponding sintered sample is decreased. In this point of view, if the additive amount of the nickel powder falls within a range of 10 mass % or less, the densification of the sintered sample is promoted by the addition of the nickel powder so as to decrease the abrasion depth thereof, but if the additive amount of the nickel powder falls within a range of more than 10 mass %, the decrease in wear resistance of the sintered sample is promoted by the distribution of the remaining nickel phase so as to increase the abrasion depth thereof. In the sintered sample 47 made of the 12 mass % of the nickel powder, the abrasion depth thereof is increased up to 1.4 μm, and if the additive amount of the nickel powder is set to more than 12 mass %, the abrasion depth of the corresponding sintered sample is increased up within a range of more than 4 μm.

In this manner, it is confirmed that the addition of the nickel powder is required for the densification of the corresponding sintered sample and the additive amount of the nickel powder should be set within a range of 1 to 12 mass %.

Referring to the sintered samples 06 and 49 to 54 shown in Tables 7 and 8, the influence in content of copper in the sintered samples and in additive amount of the copper powder can be recognized. In the sintered sample 49 not made of the copper powder, there is no problem about the corresponding thermal expansion coefficient, the wear resistance and the increase in weight due to oxidation, but there are some problems about the corresponding corrosion area ratio excessively larger than 20% so that the corrosion due to salt damage is promoted. In the sintered sample 50 containing of 1 mass % of copper relative to the total composition thereof, the salt damage is suppressed by the copper so that the corrosion area ratio is reduced within a range of 20% or less.

Up to 6 mass % of copper, the corrosion area ratio is decreased as the amount of copper is increased. On the other hand, when the amount of copper is increased, the amount of copper phase to be precipitated is increased, but the copper forming the copper phase is once melted under corrosion circumference so that the surface area of the sintered sample is increased and thus the corrosion of the sintered sample is likely to be promoted. In this point of view, if the amount of copper is increased beyond 6 mass %, the corrosion area ratio is likely to be increased. In the sintered sample 55 containing more than 10 mass % of copper, excess copper phase is precipitated so that the corrosion area ratio is increased within a range of more than 20%.

In this manner, it is confirmed that the copper can suppress the salt damage, but the content of copper should be set within a range of 1 to 10 mass % relative to the total composition of the corresponding sintered sample.

Referring to the sintered samples 06 and 56 to 61 shown in Tables 7 and 8, the influence in additive amounts of the graphite powder can be recognized. In the sintered sample 56 not made of the graphite powder, the carbide is formed originated from the carbon solid-solved in the iron alloy powder A so that the particle size of the chromium carbide formed in the phase A becomes small up to 5 μm. Moreover, Fe—P—C liquid phase is not generated while only Fe—P liquid phase is generated, resulting in the deterioration of densification at sintering and the decrease in sintered density of the sintered sample (density ratio: 85%). Therefore, the wear resistance of the sintered sample is remarkably decreased so that the abrasion depth thereof is increased up to 6.8 μm. Moreover, the decrease in sintered density of the sintered sample causes the increase in weight thereof due to oxidization. Furthermore, the precipitation amount of carbide is decreased so that the thermal expansion coefficient is decreased within a range of less than $16\times10^{-6}K^{-1}$ due to the increase of the amount of chromium to be solid-solved in the base material.

On the other hand, in the sample 57 made of 0.5 mass % of the graphite powder, the particle size of the chromium carbide to be formed in the phase A is increased up to 11 μm. Moreover, the Fe—C—P liquid phase is sufficiently generated so as to sufficiently densify the sintered sample and thus increase the sintered density of the sintered sample (density ratio: 89%). In this point of view, the abrasion depth of the sintered sample is decreased within a range of less than 2 μm. Furthermore, the increase in weight of the sintered sample due to oxidization is reduced by the sufficient densification of the sintered sample. In addition, the thermal expansion coefficient of the sintered sample is increased up to $16\times10^{-6}K^{-1}$ by the decrease of the amount of chromium which is precipitated as carbide and solid solved in the base material.

The particle size of the chromium carbide precipitated in the phase A and the phase B is increased within a range of 2 mass % or less as the additive amount of the graphite powder is increased, and in the sintered sample 60 made of 2 mass % of the graphite powder, the particle size of the chromium carbide precipitated in the phase A is increased up to 50 μm and the particle size of the chromium carbide precipitated in the phase B is increased up to 6 μm. The abrasion depths of the sintered samples are likely to be decreased by the addition of the graphite powder due to the promotion of densification therein originated from the increase in particle size of the chromium carbide and the increase in generation of the Fe—P—C liquid phase.

If the particle size of the chromium carbide precipitated in the phase A and the phase B is larger than a prescribed value, the amount of the chromium to be solid-solved in the base material is decreased. Therefore, the promotion of densification of the sintered sample becomes dominant within a range of 2 mass % or less of the graphite powder so that the increase in weight of the sintered sample due to oxidization is reduced, but the oxidation resistance of the sintered sample is decreased while the corrosion area ratio of the sintered sample is increased within a range of more than 2 mass % of the graphite powder, due to the deterioration in oxidation resistance and corrosion resistance of the corresponding sintered sample which is originated from the decrease of the amount of the chromium to be solid-solved in the base material.

In the sintered sample 61 made of more than 2 mass % of the graphite powder, the Fe—P—C liquid phase is excessively generated so as to cause the losing shape of the sintered sample.

In this manner, it is confirmed that the addition of the graphite powder is required for the precipitation of the chromium carbide at the desirable particle size and the additive amount of the graphite powder should be set within a range of 0.1 to 2 mass % so as to promote the densification of the sintered sample during sintering and enhance the wear resistance thereof.

Referring to the sintered samples 06 and 62 to 67 shown in Tables 7 and 8, the influence in additive amount of the iron-phosphorus powder can be recognized. In the sintered sample 62 not made of the iron-phosphorus powder, Fe—P—C liquid phase is not generated, resulting in the deterioration of densification at sintering and the decrease in sintered density of the sintered sample (density ratio: 82%). Therefore, the increase in weight of the sintered sample due to oxidization is developed. Moreover, since the Fe—P—C liquid phase is not generated so that the sintering is not actively conducted, the particle size of the chromium carbide precipitated in the phase A is decreased within a range of less than 10 μm so that the abrasion depth of the sintered sample is increased by the decrease in particle size of the chromium carbide to be precipitated in the phase A and the decrease of strength of the sintered sample due to the decrease of the sintered density.

On the other hand, in the sample 63 made of 1 mass % of the iron-phosphorus powder, the Fe—C—P liquid phase is sufficiently generated so as to sufficiently densify the sintered sample and thus increase the sintered density of the sintered sample (density ratio: 88%). In this point of view, the increase in weight of the sintered sample due to oxidization and the corrosion area ratio of the sintered sample is reduced by the sufficient densification of the sintered sample. Moreover, since the Fe—P—C liquid phase is sufficiently generated so that the sintering is actively conducted, the particle size of the chromium carbide precipitated in the phase A is increased up to 10 μm so that the abrasion depth of the sintered sample is decreased by the increase of strength of the sintered sample due to the increase of the sintered density.

In the case that the additive amount of the iron-phosphorus powder is much increased, the amount of the Fe—C—P liquid phase is increased and the sintering is actively conducted as the additive amount of the iron-phosphorus powder is increased, thereby growing the chromium carbide precipitated in the phase A and the phase B remarkably.

However, the promotion of densification of the sintered sample becomes dominant within an additive amount range of 5 mass % or less of the iron-phosphorus powder so as to increase the sintered density thereof (density ratio: 95%) by the generation of the Fe—C—P liquid phase, but does not become dominant within an additive amount range of more than 5 mass % of the iron-phosphorus powder so as to decrease the sintered density by the temporally excess generation of the Fe—C—P liquid phase causing the enlargement of the space between the adjacent powder and the prevention of densification due to liquid phase contraction. As a result, the abrasion depth, the increase in weight due to oxidization and the corrosion area ratio of the sintered sample are likely to be decreased within an additive amount range of 5 mass % or less of the iron-phosphorus powder, but increased within an additive amount range of more than 5 mass % of the iron-phosphorus powder subject to the decrease of the sintered density.

In the sintered sample 67 made of more than 5 mass % of the iron-phosphorus powder, the Fe—P—C liquid phase is excessively generated so as to cause the losing shape of the sintered sample.

In this manner, it is confirmed that the addition of the iron-phosphorus powder is required for the promotion of densification of the sintered sample during sintering causing the enhancement the wear resistance thereof and the additive amount of the iron-phosphorus powder should be set within a range of 1 to 5 mass %.

Example 5

The raw material powder was prepared in the same manner as the sintered sample 06 in Example 1 with respect to the mixing ratio of the iron alloy powder A and the like and the composition, compressed in the same manner as in Example 1 and sintered at the respective sintering temperatures shown in Table 9 instead of the sintering temperatures in Example 1 to form the sintered samples 61 to 66 in the shape of pillar, in the shape of square pillar and in the shape of thin plate. With respect to the sintered samples, the average particle diameter of carbide in the phase A and the phase B, the ratio of the phase A, the maximum dimension of the phase A, the thermal expansion coefficient, the increase in weight after oxidizing test and the abrasion depth after roll-on-disc abrasion test were measured in the same manner as in Example 1. The results were listed in Table 9. In Table 9, the results of the sintered sample 06 obtained in Example 1 were listed together.

TABLE 9

| SINTERING SAMPLE | SINTERING TEMPARATURE °C. | AVERAGE PARTICLE DIAMETER OF CARBIDE [μm] PHASE A | PHASE B | AREA RATIO OF PHASE A, % | MAXIMUM DIAMETER OF PHASE A, μm | THERMAL EXPANSION COEFFICENT, $10^{-6}K^{-1}$ | AVERAGE ABRASION DEPTH, μm | INCREASE IN WEIGHT DUE TO OXIDIZATION, g/m² 850° C. | 900° C. | 950° C. |
|---|---|---|---|---|---|---|---|---|---|---|
| 68 | 950 | 6 | 1 | 47 | 160 | 16.6 | 3.1 | 14 | 17 | 35 |
| 69 | 1000 | 12 | 2 | 49 | 200 | 16.5 | 1.8 | 8 | 14 | 18 |
| 70 | 1050 | 13 | 3 | 52 | 250 | 16.6 | 1.4 | 5 | 12 | 15 |
| 06 | 1100 | 15 | 3 | 53 | 280 | 16.7 | 1.2 | 3 | 6 | 10 |
| 71 | 1150 | 17 | 5 | 47 | 300 | 16.7 | 1.2 | 2 | 4 | 9 |
| 72 | 1200 | 20 | 7 | 38 | 310 | 16.6 | 1.8 | 2 | 3 | 8 |
| 73 | 1250 | 22 | 18 | 10 | 360 | 16.6 | 2.4 | 3 | 4 | 10 |

| SINTERING SAMPLE | CORROSION AREA RATIO, % | NOTE |
|---|---|---|
| 68 | 22 | SINTERING TEMPARATUTE LESS THAN LOWER LIMITED VALUE |
| 69 | 13 | SINTERING TEMPARATURE EQUAL TO LOWER LIMITED VALUE |
| 70 | 8 | |
| 06 | 5 | |
| 71 | 5 | |
| 72 | 5 | SINTERING TEMPARATURE EQUAL TO UPPER LIMITED VALUE |
| 73 | 12 | SINTERING TEMPARATURE MORE THAN UPPER LIMITED VALUE |

Referring to the sintered samples 06 and 68 to 73 shown in Table 9, the influence of the sintering temperature can be recognized. In the sintered sample 68 sintered at a sintering temperature of 950° C., since the sintering temperature is smaller than the temperature where Fe—P liquid phase is generated, Fe—P—C liquid phase is not generated, resulting in the deterioration of the densification of the sintered sample and thus the decrease in density of the sintered sample (density ratio: 82%). The increase in weight due to oxidization and the corrosion area ratio of the sintered sample is therefore relatively developed. Moreover, the sintering is not actively conducted because the Fe—P—C liquid phase is not generated so that the particle size of the chromium carbide precipitated in the phase A is decreased within a range of less than 10 μm, so that the abrasion depth of the sintered sample is increased due to the decrease of the particle size of the chromium carbide and the decrease of the wear resistance thereof by the decrease of the strength thereof originated from the decrease of the sintered density thereof.

On the other hand, in the sintered sample 69 sintered at a sintering temperature of 1000° C., the Fe—P—C liquid phase is sufficiently generated, allowing the enhancement of the densification of the sintered sample and thus the increase in density of the sintered sample (density ratio: 87%). The increase in weight due to oxidization and the corrosion area ratio of the sintered sample are therefore reduced. Moreover, the sintering is actively conducted because the Fe—P—C liquid phase is sufficiently generated so that the particle size of the chromium carbide precipitated in the phase A is increased within a range of more than 10 μm. Therefore, the abrasion depth of the sintered sample is decreased due to the increase of the strength thereof originated from the increase of the sintered density thereof.

If the sintering temperature is much increased, the sintering is actively conducted so as to promote the densification of the sintered sample and thus the decrease in weight of the sintered sample due to oxidization as the sintering temperature is increased. However, the difference in concentration between the phase A and the phase B becomes small due to the diffusions of the respective elements contained in the phase A and phase B with the increase of the activity of the sintering so that the chromium carbide contained in the phase B grows remarkably as compared with the chromium carbide contained in the phase A. The growth of the chromium carbide in the phase B prevents the plastic flow of the base material so as to contribute to the decrease of the abrasion depth of the sintered sample to some degrees. However, the too growth of the chromium carbide increases the attack on the opponent component (rolling member) so that the abrasion powder of the opponent component serves as abrading agent. Moreover, the too growth of the chromium carbide decreases the precipitation area of the carbide that the space between the adjacent carbide is enlarged so as to increase the number of origin of metallic adhesion. As a result, the abrasion of the sintered sample is increased.

In this manner, it is confirmed that the sintered temperature is set within a range of 1000 to 1200° C.

Example 6

The iron alloy powders A and the iron alloy powders B having the respective compositions shown in Table 10 were prepared, and mixed with the iron-phosphorus alloy powder, the nickel powder and the graphite powder which were used in Example 1 at the ratios shown in Table 10 to blend the respective raw material powders. The thus obtained raw material powders were compressed and sintered in the same manner as in Example 1 to form sintered samples 74 to 100 in the shape of pillar, in the shape of square pillar and in the shape of thin plate. The compositions of the sintered samples were listed in Table 11. With respect to the sintered samples, the average particle diameter of carbide in the phase A and the phase B, the ratio of the phase A, the maximum dimension of the phase A, the thermal expansion coefficient, the increase in weight after oxidizing test, the corrosion area ratio and the abrasion depth after roll-on-disc abrasion test were measured in the same manner as in Example 1. The results were listed in Table 11. In Tables 10 and 11, the composition and measured results of the sintered sample 06 obtained in Example 1 were listed together.

TABLE 10

| SINTERED SAMPLE | MIXING RATIO MASS % | | | | | | | | | | | | | |
|---|---|---|---|---|---|---|---|---|---|---|---|---|---|---|
| | IRON ALLOY POWDER | COMPOSITION, MASS % | | | | | | | IRON ALLOY POWDER | COMPOSITION, MASS % | | | | |
| | A | Fe | Cr | Ni | Si | C | Mo | V | B | Fe | Cr | Ni | Mo | V |
| 06 | 42.5 | BALANCE | 34.0 | 10.0 | 2.0 | 2.0 | 0.0 | — | 42.5 | BALANCE | 18.0 | 8.0 | — | — |
| 74 | 42.5 | BALANCE | 34.0 | 10.0 | 2.0 | 2.0 | 2.2 | — | 42.5 | BALANCE | 18.0 | 8.0 | — | — |
| 75 | 42.5 | BALANCE | 34.0 | 10.0 | 2.0 | 2.0 | 4.4 | — | 42.5 | BALANCE | 18.0 | 8.0 | — | — |
| 76 | 42.5 | BALANCE | 34.0 | 10.0 | 2.0 | 2.0 | 6.6 | — | 42.5 | BALANCE | 18.0 | 8.0 | — | — |
| 77 | 42.5 | BALANCE | 34.0 | 10.0 | 2.0 | 2.0 | 11.0 | — | 42.5 | BALANCE | 18.0 | 8.0 | — | — |
| 78 | 42.5 | BALANCE | 34.0 | 10.0 | 2.0 | 2.0 | 15.4 | — | 42.5 | BALANCE | 18.0 | 8.0 | — | — |
| 06 | 42.5 | BALANCE | 34.0 | 10.0 | 2.0 | 2.0 | — | — | 42.5 | BALANCE | 18.0 | 8.0 | 0.0 | — |
| 79 | 42.5 | BALANCE | 34.0 | 10.0 | 2.0 | 2.0 | — | — | 42.5 | BALANCE | 18.0 | 8.0 | 2.2 | — |
| 80 | 42.5 | BALANCE | 34.0 | 10.0 | 2.0 | 2.0 | — | — | 42.5 | BALANCE | 18.0 | 8.0 | 4.4 | — |
| 81 | 42.5 | BALANCE | 34.0 | 10.0 | 2.0 | 2.0 | — | — | 42.5 | BALANCE | 18.0 | 8.0 | 6.6 | — |
| 82 | 42.5 | BALANCE | 34.0 | 10.0 | 2.0 | 2.0 | — | — | 42.5 | BALANCE | 18.0 | 8.0 | 11.0 | — |
| 83 | 42.5 | BALANCE | 34.0 | 10.0 | 2.0 | 2.0 | — | — | 42.5 | BALANCE | 18.0 | 8.0 | 15.4 | — |
| 75 | 42.5 | BALANCE | 34.0 | 10.0 | 2.0 | 2.0 | — | — | 42.5 | BALANCE | 18.0 | 8.0 | 0.0 | — |
| 84 | 42.5 | BALANCE | 34.0 | 10.0 | 2.0 | 2.0 | 4.4 | — | 42.5 | BALANCE | 18.0 | 8.0 | 2.2 | — |
| 85 | 42.5 | BALANCE | 34.0 | 10.0 | 2.0 | 2.0 | 4.4 | — | 42.5 | BALANCE | 18.0 | 8.0 | 4.4 | — |
| 86 | 42.5 | BALANCE | 34.0 | 10.0 | 2.0 | 2.0 | 4.4 | — | 42.5 | BALANCE | 18.0 | 8.0 | 6.6 | — |
| 06 | 42.5 | BALANCE | 34.0 | 10.0 | 2.0 | 2.0 | 4.4 | 0.0 | 42.5 | BALANCE | 18.0 | 8.0 | 11.0 | — |
| 87 | 42.5 | BALANCE | 34.0 | 10.0 | 2.0 | 2.0 | — | 2.2 | 42.5 | BALANCE | 18.0 | 8.0 | — | — |
| 88 | 42.5 | BALANCE | 34.0 | 10.0 | 2.0 | 2.0 | — | 4.4 | 42.5 | BALANCE | 18.0 | 8.0 | — | — |
| 89 | 42.5 | BALANCE | 34.0 | 10.0 | 2.0 | 2.0 | — | 6.6 | 42.5 | BALANCE | 18.0 | 8.0 | — | — |
| 90 | 42.5 | BALANCE | 34.0 | 10.0 | 2.0 | 2.0 | — | 11.0 | 42.5 | BALANCE | 18.0 | 8.0 | — | — |
| 91 | 42.5 | BALANCE | 34.0 | 10.0 | 2.0 | 2.0 | — | 15.4 | 42.5 | BALANCE | 18.0 | 8.0 | — | — |
| 06 | 42.5 | BALANCE | 34.0 | 10.0 | 2.0 | 2.0 | — | — | 42.5 | BALANCE | 18.0 | 8.0 | — | 0.0 |
| 92 | 42.5 | BALANCE | 34.0 | 10.0 | 2.0 | 2.0 | — | — | 42.5 | BALANCE | 18.0 | 8.0 | — | 2.2 |
| 93 | 42.5 | BALANCE | 34.0 | 10.0 | 2.0 | 2.0 | — | — | 42.5 | BALANCE | 18.0 | 8.0 | — | 4.4 |
| 94 | 42.5 | BALANCE | 34.0 | 10.0 | 2.0 | 2.0 | — | — | 42.5 | BALANCE | 18.0 | 8.0 | — | 6.6 |
| 95 | 42.5 | BALANCE | 34.0 | 10.0 | 2.0 | 2.0 | — | — | 42.5 | BALANCE | 18.0 | 8.0 | — | 11.0 |
| 96 | 42.5 | BALANCE | 34.0 | 10.0 | 2.0 | 2.0 | — | — | 42.5 | BALANCE | 18.0 | 8.0 | — | 15.4 |
| 97 | 42.5 | BALANCE | 34.0 | 10.0 | 2.0 | 2.0 | — | 4.4 | 42.5 | BALANCE | 18.0 | 8.0 | — | 0.0 |
| 98 | 42.5 | BALANCE | 34.0 | 10.0 | 2.0 | 2.0 | — | 4.4 | 42.5 | BALANCE | 18.0 | 8.0 | — | 2.2 |
| 99 | 42.5 | BALANCE | 34.0 | 10.0 | 2.0 | 2.0 | — | 4.4 | 42.5 | BALANCE | 18.0 | 8.0 | — | 6.6 |
| 100 | 42.5 | BALANCE | 34.0 | 10.0 | 2.0 | 2.0 | — | 4.4 | 42.5 | BALANCE | 18.0 | 8.0 | — | 11.0 |

| | MIXING RATIO MASS % | | | | |
|---|---|---|---|---|---|
| SINTERED SAMPLE | NICKEL POWDER | IRON-PHOSPHOROUS ALLOY POWDER B | COPPER POWDER | GRAPHITE POWDER | A/B |
| 06 | 5.0 | 3.0 | 6.0 | 1.0 | 50 |
| 74 | 5.0 | 3.0 | 6.0 | 1.0 | 50 |

TABLE 10-continued

| | | | | | |
|---|---|---|---|---|---|
| 75 | 5.0 | 3.0 | 6.0 | 1.0 | 50 |
| 76 | 5.0 | 3.0 | 6.0 | 1.0 | 50 |
| 77 | 5.0 | 3.0 | 6.0 | 1.0 | 50 |
| 78 | 5.0 | 3.0 | 6.0 | 1.0 | 50 |
| 06 | 5.0 | 3.0 | 6.0 | 1.0 | 50 |
| 79 | 5.0 | 3.0 | 6.0 | 1.0 | 50 |
| 80 | 5.0 | 3.0 | 6.0 | 1.0 | 50 |
| 81 | 5.0 | 3.0 | 6.0 | 1.0 | 50 |
| 82 | 5.0 | 3.0 | 6.0 | 1.0 | 50 |
| 83 | 5.0 | 3.0 | 6.0 | 1.0 | 50 |
| 75 | 5.0 | 3.0 | 6.0 | 1.0 | 50 |
| 84 | 5.0 | 3.0 | 6.0 | 1.0 | 50 |
| 85 | 5.0 | 3.0 | 6.0 | 1.0 | 50 |
| 86 | 5.0 | 3.0 | 6.0 | 1.0 | 50 |
| 06 | 5.0 | 3.0 | 6.0 | 1.0 | 50 |
| 87 | 5.0 | 3.0 | 6.0 | 1.0 | 50 |
| 88 | 5.0 | 3.0 | 6.0 | 1.0 | 50 |
| 89 | 5.0 | 3.0 | 6.0 | 1.0 | 50 |
| 90 | 5.0 | 3.0 | 6.0 | 1.0 | 50 |
| 91 | 5.0 | 3.0 | 6.0 | 1.0 | 50 |
| 06 | 5.0 | 3.0 | 6.0 | 1.0 | 50 |
| 92 | 5.0 | 3.0 | 6.0 | 1.0 | 50 |
| 93 | 5.0 | 3.0 | 6.0 | 1.0 | 50 |
| 94 | 5.0 | 3.0 | 6.0 | 1.0 | 50 |
| 95 | 5.0 | 3.0 | 6.0 | 1.0 | 50 |
| 96 | 5.0 | 3.0 | 6.0 | 1.0 | 50 |
| 97 | 5.0 | 3.0 | 6.0 | 1.0 | 50 |
| 98 | 5.0 | 3.0 | 6.0 | 1.0 | 50 |
| 99 | 5.0 | 3.0 | 6.0 | 1.0 | 50 |
| 100 | 5.0 | 3.0 | 6.0 | 1.0 | 50 |

TABLE 11

| SINTERED SAMPLE | COMPOSITION, MASS % | | | | | | | | | AVERAGE PARTICLE DIAMETER OF CARBIDE [μm] | | AREA RATIO OF | MAXIMUM DIAMETER OF | THERMAL EXPANSION COEFFICIENT, |
|---|---|---|---|---|---|---|---|---|---|---|---|---|---|---|
| | Fe | Cr | Ni | Si | P | C | Cu | Mo | V | PHASE A | PHASE B | PHASE A, % | PHASE A, μm | $10^{-6}K^{-1}$ |
| 06 | BALANCE | 22.10 | 12.65 | 0.85 | 0.60 | 1.65 | 6.00 | 0.00 | — | 15 | 3 | 53 | 280 | 16.7 |
| 74 | BALANCE | 22.10 | 12.65 | 0.85 | 0.60 | 1.65 | 6.00 | 0.93 | — | 16 | 3 | 53 | 270 | 16.6 |
| 75 | BALANCE | 22.10 | 12.65 | 0.85 | 0.60 | 1.65 | 6.00 | 1.87 | — | 17 | 3 | 53 | 270 | 16.6 |
| 76 | BALANCE | 22.10 | 12.65 | 0.85 | 0.60 | 1.65 | 6.00 | 2.80 | — | 20 | 3 | 54 | 280 | 16.4 |
| 77 | BALANCE | 22.10 | 12.65 | 0.85 | 0.60 | 1.65 | 6.00 | 4.67 | — | 25 | 3 | 54 | 280 | 16.2 |
| 78 | BALANCE | 22.10 | 12.65 | 0.85 | 0.60 | 1.65 | 6.00 | 6.54 | — | 28 | 3 | 55 | 270 | 15.8 |
| 06 | BALANCE | 22.10 | 12.65 | 0.85 | 0.60 | 1.65 | 6.00 | 0.00 | — | 15 | 3 | 53 | 280 | 16.7 |
| 79 | BALANCE | 22.10 | 12.65 | 0.85 | 0.60 | 1.65 | 6.00 | 0.93 | — | 15 | 4 | 53 | 270 | 16.7 |
| 80 | BALANCE | 22.10 | 12.65 | 0.85 | 0.60 | 1.65 | 6.00 | 1.87 | — | 15 | 6 | 50 | 270 | 16.6 |
| 81 | BALANCE | 22.10 | 12.65 | 0.85 | 0.60 | 1.65 | 6.00 | 2.80 | — | 15 | 7 | 50 | 250 | 16.3 |
| 82 | BALANCE | 22.10 | 12.65 | 0.85 | 0.60 | 1.65 | 6.00 | 4.67 | — | 15 | 9 | 48 | 240 | 16.0 |
| 83 | BALANCE | 22.10 | 12.65 | 0.85 | 0.60 | 1.65 | 6.00 | 6.54 | — | 15 | 12 | 48 | 220 | 15.7 |
| 75 | BALANCE | 22.10 | 12.65 | 0.85 | 0.60 | 1.65 | 6.00 | 1.87 | — | 17 | 3 | 53 | 270 | 15.6 |
| 84 | BALANCE | 22.10 | 12.65 | 0.85 | 0.60 | 1.65 | 6.00 | 2.81 | — | 18 | 3 | 51 | 250 | 16.4 |
| 85 | BALANCE | 22.10 | 12.65 | 0.85 | 0.60 | 1.65 | 6.00 | 4.67 | — | 19 | 5 | 50 | 250 | 16.1 |
| 86 | BALANCE | 22.10 | 12.65 | 0.85 | 0.60 | 1.65 | 6.00 | 6.54 | — | 19 | 7 | 48 | 240 | 15.8 |
| 06 | BALANCE | 22.10 | 12.65 | 0.85 | 0.60 | 1.65 | 6.00 | — | 0.00 | 15 | 3 | 53 | 280 | 16.7 |
| 87 | BALANCE | 22.10 | 12.65 | 0.85 | 0.60 | 1.65 | 6.00 | — | 0.93 | 14 | 3 | 52 | 280 | 16.6 |
| 88 | BALANCE | 22.10 | 12.65 | 0.85 | 0.60 | 1.65 | 6.00 | — | 1.87 | 13 | 3 | 52 | 260 | 16.6 |
| 89 | BALANCE | 22.10 | 12.65 | 0.85 | 0.60 | 1.65 | 6.00 | — | 2.80 | 13 | 3 | 50 | 270 | 16.4 |
| 90 | BALANCE | 22.10 | 12.65 | 0.85 | 0.60 | 1.65 | 6.00 | — | 4.67 | 12 | 3 | 51 | 260 | 16.3 |
| 91 | BALANCE | 22.10 | 12.65 | 0.85 | 0.60 | 1.65 | 6.00 | — | 6.54 | 12 | 3 | 50 | 250 | 15.8 |
| 06 | BALANCE | 22.10 | 12.65 | 0.85 | 0.60 | 1.65 | 6.00 | — | 0.00 | 15 | 3 | 53 | 280 | 16.7 |
| 92 | BALANCE | 22.10 | 12.65 | 0.85 | 0.60 | 1.65 | 6.00 | — | 0.93 | 15 | 2 | 53 | 270 | 16.7 |
| 93 | BALANCE | 22.10 | 12.65 | 0.85 | 0.60 | 1.65 | 6.00 | — | 1.87 | 15 | 2 | 52 | 260 | 16.5 |
| 94 | BALANCE | 22.10 | 12.65 | 0.85 | 0.60 | 1.65 | 6.00 | — | 2.80 | 14 | 2 | 52 | 260 | 15.5 |
| 95 | BALANCE | 22.10 | 12.65 | 0.85 | 0.60 | 1.65 | 6.00 | — | 4.67 | 14 | 2 | 50 | 260 | 16.3 |
| 96 | BALANCE | 22.10 | 12.65 | 0.85 | 0.60 | 1.65 | 6.00 | — | 6.54 | 14 | 2 | 48 | 240 | 15.7 |
| 97 | BALANCE | 22.10 | 12.65 | 0.85 | 0.60 | 1.65 | 6.00 | — | 1.87 | 13 | 3 | 52 | 260 | 16.6 |
| 98 | BALANCE | 22.10 | 12.65 | 0.85 | 0.60 | 1.65 | 6.00 | — | 2.81 | 12 | 2 | 50 | 250 | 16.4 |
| 99 | BALANCE | 22.10 | 12.65 | 0.85 | 0.60 | 1.65 | 6.00 | — | 4.67 | 12 | 2 | 49 | 240 | 16.2 |
| 100 | BALANCE | 22.10 | 12.65 | 0.85 | 0.60 | 1.65 | 6.00 | — | 6.54 | 12 | 2 | 47 | 230 | 15.8 |

TABLE 11-continued

| SINTERED SAMPLE | AVERAGE ABRASION DEPTH μm | INCREASE IN WEIGHT DUE TO OXIDIZATION, g/m² 850° C. | 900° C. | 950° C. | CORROSION AREA RATIO, % | NOTE |
|---|---|---|---|---|---|---|
| 06 | 1.2 | 3 | 6 | 10 | 5 | |
| 74 | 1.2 | 3 | 6 | 10 | 5 | |
| 75 | 1.2 | 3 | 6 | 9 | 4 | |
| 76 | 1.1 | 3 | 6 | 9 | 4 | |
| 77 | 1.1 | 2 | 5 | 9 | 3 | CONTENT OF Mo EQUAL TO UPPER LIMITED VALUE |
| 78 | 1.1 | 3 | 5 | 8 | 3 | CONTENT OF Mo MORE THAN UPPER LIMITED VALUE |
| 06 | 1.2 | 3 | 6 | 10 | 5 | |
| 79 | 1.2 | 3 | 6 | 10 | 5 | |
| 80 | 1.2 | 3 | 6 | 8 | 5 | |
| 81 | 1.2 | 2 | 5 | 8 | 4 | |
| 82 | 1.1 | 2 | 5 | 8 | 4 | CONTENT OF Mo EQUAL TO UPPER LIMITED VALUE |
| 83 | 1.1 | 2 | 5 | 8 | 3 | CONTENT OF Mo MORE THAN UPPER LIMITED VALUE |
| 75 | 1.2 | 3 | 6 | 9 | 4 | |
| 84 | 1.2 | 2 | 5 | 8 | 4 | |
| 85 | 1.1 | 2 | 5 | 7 | 3 | CONTENT OF Mo EQUAL TO UPPER LIMITED VALUE |
| 86 | 1.1 | 2 | 3 | 7 | 3 | CONTENT OF Mo MORE THAN UPPER LIMITED VALUE |
| 06 | 1.2 | 3 | 6 | 10 | 5 | |
| 87 | 1.1 | 3 | 6 | 10 | 5 | |
| 88 | 1.1 | 3 | 5 | 8 | 4 | |
| 89 | 1.2 | 2 | 5 | 8 | 4 | |
| 90 | 1.1 | 2 | 5 | 8 | 4 | CONTENT OF V EQUAL TO UPPER LIMITED VALUE |
| 91 | 1.0 | 2 | 5 | 8 | 4 | CONTENT OF V MORE THAN UPPER LIMITED VALUE |
| 06 | 1.2 | 3 | 6 | 10 | 5 | |
| 92 | 1.2 | 3 | 6 | 9 | 5 | |
| 93 | 1.1 | 2 | 6 | 9 | 5 | |
| 94 | 1.1 | 2 | 6 | 9 | 4 | |
| 95 | 1.1 | 2 | 5 | 9 | 4 | CONTENT OF V EQUAL TO UPPER LIMITED VALUE |
| 96 | 1.1 | 2 | 5 | 8 | 4 | CONTENT OF V MORE THAN UPPER LIMITED VALUE |
| 97 | 1.1 | 3 | 5 | 8 | 4 | |
| 98 | 1.1 | 3 | 5 | 8 | 4 | |
| 99 | 1.0 | 2 | 5 | 8 | 4 | CONTENT OF V EQUAL TO UPPER LIMITED VALUE |
| 100 | 1.0 | 2 | 4 | 8 | 4 | CONTENT OF V MORE THAN UPPER LIMITED VALUE |

Referring to the sintered samples 06 and 74 to 86 shown in Tables 10 and 11, the influence of molybdenum (Mo) as an additive element can be recognized. In the sintered sample 06 and 74 to 78, molybdenum is added to the iron alloy powder A, and in the sintered sample 06 and 79 to 83, molybdenum is added to the iron alloy powder B, and in the sintered sample 06 and 84 to 86, molybdenum is added to both of the iron alloy powder A and the iron alloy powder B.

The molybdenum has a high formability of carbide, and in any case where the molybdenum is added to the iron alloy powder A and the molybdenum is added to the iron alloy powder B, and the molybdenum is added to both of the iron alloy powder A and the iron alloy powder B, the wear resistance of the corresponding sintered sample is enhanced, and the abrasion depth of the corresponding sintered sample is decreased as the additive amount of the molybdenum is increased. In any case as described above, moreover, the increase in weight of the sintered sample due to oxidization is likely to be reduced as the additive amount of the molybdenum is increased.

In any case, however, the thermal expansion coefficient of the sintered sample is likely to be decreased as the additive amount of the molybdenum is increased, and in the sintered sample 78, 83 and 86 containing the additive amount of more than 5 mass %, the thermal expansion coefficient of the corresponding sintered sample is decreased within a range of less than $16\times10^{-6}K^{-1}$.

In this manner, it is confirmed that the additive amount of the molybdenum should be set within a range of 5 mass % or less relative to the composition of the corresponding sintered sample because the addition of the molybdenum enhances the wear resistance and oxidation resistance of the corresponding sintered sample but if the additive amount of the molybdenum is more than 5 mass % relative to the composition of the corresponding sintered sample, the thermal expansion coefficient of the corresponding sintered sample is decreased within a range of less than $16\times10^{-6}K^{-1}$.

Referring to the sintered samples 06 and 87 to 100 shown in Tables 10 and 11, the influence of vanadium (V) as an additive element can be recognized. In the sintered sample 06 and 87 to 91, vanadium is added to the iron alloy powder A, and in the sintered sample 06 and 92 to 96, vanadium is added to the iron alloy powder B, and in the sintered sample 06 and 97 to 100, vanadium is added to both of the iron alloy powder A and the iron alloy powder B.

The vanadium has a high formability of carbide, and in any case where the vanadium is added to the iron alloy powder A and the vanadium is added to the iron alloy powder B, and the vanadium is added to both of the iron alloy powder A and the iron alloy powder B, the wear resistance of the corresponding sintered sample is enhanced, and the abrasion depth of the corresponding sintered sample is decreased as the additive amount of the vanadium is increased. In any case as described above, moreover, the increase in weight of the sintered sample due to oxidization is likely to be reduced as the additive amount of the vanadium is increased.

In any case, however, the thermal expansion coefficient of the sintered sample is likely to be decreased as the additive amount of the vanadium is increased, and in the sintered sample 91, 96 and 100 containing the additive amount of more than 5 mass %, the thermal expansion coefficient of the corresponding sintered sample is decreased within a range of less than $16\times10^{6}K^{-1}$.

In this manner, it is confirmed that the additive amount of the vanadium should be set within a range of 5 mass % or less relative to the composition of the corresponding sintered sample because the addition of the vanadium enhances the wear resistance and oxidation resistance of the corresponding sintered sample but if the additive amount of the vanadium is more than 5 mass % relative to the composition of the corresponding sintered sample, the thermal expansion coefficient of the corresponding sintered sample is decreased within a range of $16\times10^{-6}K^{-1}$.

Although the present invention was described in detail with reference to the above examples, this invention is not limited to the above disclosure and every kind of variation and modification may be made without departing from the scope of the present invention.

INDUSTRIAL APPLICABILITY

The sintered alloy of the present invention exhibits such a metallic structure as the phase A containing precipitated metallic carbide within an average particle diameter of 5 to 50 μm are randomly dispersed in the phase B containing precipitated metallic carbide within an average particle diameter of 10 μm or less and excellent heat resistance, corrosion resistance and wear resistance at high temperature. Moreover, the sintered alloy has thermal expansion coefficient similar to the one of an austenitic heat-resistant material because the sintered alloy has an austenitic base material. Furthermore, since the sintered alloy has copper therein, the sintered alloy has corrosion resistance against salt damage. In this point of view, the sintered alloy is preferable for a turbo component for turbocharger and a bearing requiring heat resistance, corrosion resistance and wear resistance, etc.

What is claimed is:

1. A method for manufacturing a sintered alloy, comprising the steps of:

preparing an iron alloy powder A consisting of, in percentage by mass, Cr: 25 to 45, Ni: 5 to 15, Si: 1.0 to 3.0, C: 0.5 to 4.0 and a balance of Fe plus unavoidable impurities;

preparing an iron alloy powder B consisting of, in percentage by mass, Cr: 12 to 25, Ni: 5 to 15 and a balance of Fe plus unavoidable impurities;

preparing an iron-phosphorus powder consisting of, in percentage by mass, P:10 to 30 and the balance of Fe plus unavoidable impurities or P: 5 to 25 and a balance of Cu plus unavoidable impurities, a nickel powder, a copper powder or a copper alloy powder, and graphite powder;

forming a raw material powder, consisting of, in percentage by mass, Cr: 10.37 to 39.73, Ni: 5.10 to 24.89, Si: 0.14 to 2.52, Cu: 1.0 to 10.0, P: 0.1 to 1.5, C: 0.18 to 3.20 and a balance of Fe plus unavoidable impurities by mixing the iron alloy powder A with the iron alloy powder B so that a ratio of the iron alloy powder A to the total of the iron alloy powder A and the iron alloy powder B is within a range of 20 to 80 mass %, and adding the iron-phosphorus powder, the nickel powder, the copper powder or copper alloy powder, and the graphite powder;

pressing the raw material powder to obtain a compact; and sintering the compact.

2. The manufacturing method as set forth in claim 1, wherein a maximum particle diameter of the iron alloy powder A is set within a range of 300 μm or less, which corresponds to a powder passing a sieve with 50 mesh.

3. The manufacturing method as set forth in claim 1, wherein a maximum particle diameter of the nickel powder is set within a range of 74 μm or less, which corresponds to a powder passing a sieve with 200 mesh.

4. The manufacturing method as set forth in claim 1, wherein the copper alloy powder is a copper-nickel alloy powder.

5. The manufacturing method as set forth in claim 1, further comprising a step of adding 5 mass % or less of at least one selected from the group consisting of Mo, V, W, Nb and Ti to either or both of the iron alloy powder A and the iron alloy powder B.

6. The manufacturing method as set forth in claim 1, wherein a sintering temperature at the sintering is set within a range of 1000 to 1200° C.

* * * * *